US010076167B2

(12) United States Patent
Kim

(10) Patent No.: US 10,076,167 B2
(45) Date of Patent: Sep. 18, 2018

(54) LUGGAGE SYSTEM WITH TRANSPORT PLATFORM

(71) Applicant: Soon Young Kim, New York, NY (US)

(72) Inventor: Soon Young Kim, New York, NY (US)

( * ) Notice: Subject to any disclaimer, the term of this patent is extended or adjusted under 35 U.S.C. 154(b) by 0 days.

(21) Appl. No.: 15/180,736

(22) Filed: Jun. 13, 2016

(65) Prior Publication Data

US 2017/0354219 A1 Dec. 14, 2017

(51) Int. Cl.

| | |
|---|---|
| ***A45C 9/00*** | (2006.01) |
| ***A45C 5/03*** | (2006.01) |
| ***A45C 5/14*** | (2006.01) |
| ***A45C 13/26*** | (2006.01) |

(52) U.S. Cl.

CPC ..... *A45C 9/00* (2013.01); *A45C 5/03* (2013.01); *A45C 5/14* (2013.01); *A45C 13/262* (2013.01)

(58) Field of Classification Search

CPC ..... A45C 9/00; A45C 13/38; A45C 5/146
See application file for complete search history.

(56) References Cited

U.S. PATENT DOCUMENTS

| | | | | |
|---|---|---|---|---|
| 4,273,222 | A * | 6/1981 | Cassimally | A45C 5/146 190/18 A |
| 5,529,322 | A * | 6/1996 | Barton | A45C 5/14 108/147.11 |
| 5,730,264 | A | 3/1998 | Lu | |
| 6,149,168 | A * | 11/2000 | Pauser | B25H 3/00 280/43.1 |
| 6,688,614 | B2 | 2/2004 | Hsu | |
| 6,832,670 | B2 * | 12/2004 | Wolters | A45C 9/00 190/115 |
| 7,014,020 | B2 | 3/2006 | Tamura | |
| 7,870,937 | B1 * | 1/2011 | Arnao | A45C 9/00 190/1 |
| 8,146,722 | B1 * | 4/2012 | Moreno | A45C 5/14 190/115 |
| 8,282,109 | B1 * | 10/2012 | Arjomand | A45F 4/02 280/30 |
| 8,282,113 | B2 | 10/2012 | Veal et al. | |
| 8,517,398 | B1 | 8/2013 | Wilson | |
| 8,540,063 | B2 * | 9/2013 | Latowsky | A45C 5/14 190/18 A |
| 9,033,350 | B2 | 5/2015 | Porri | |
| 9,090,274 | B1 | 7/2015 | Arjomand et al. | |
| 2004/0021353 | A1 | 2/2004 | Lozano et al. | |
| 2004/0069583 | A1 | 4/2004 | Tamura | |
| 2005/0212267 | A1 * | 9/2005 | Hsu | A45C 5/14 280/655 |

(Continued)

FOREIGN PATENT DOCUMENTS

| | | |
|---|---|---|
| TW | M332406 U | 5/2008 |
| WO | 0059332 A1 | 10/2000 |

OTHER PUBLICATIONS

International Search Report for PCT Application No. PCT/US2017/037228 dated Sep. 1, 2017.

*Primary Examiner* — Sue A Weaver
(74) *Attorney, Agent, or Firm* — St. Onge Steward Johnston & Reens, LLC

(57) ABSTRACT

A luggage transport system includes a first piece of luggage, a transport platform movably coupled to the first piece of luggage, and at least one additional piece of luggage supported on the transport platform, wherein the transport platform is adapted to be elevated and lowered relative the first piece of luggage.

19 Claims, 32 Drawing Sheets

(56) References Cited

U.S. PATENT DOCUMENTS

| | | | | |
|---|---|---|---|---|
| 2006/0045677 | A1* | 3/2006 | Garfield | A45C 13/385<br>414/340 |
| 2008/0217130 | A1 | 9/2008 | Louis | |
| 2009/0255771 | A1* | 10/2009 | Puchalski | A45C 5/14<br>190/18 A |
| 2009/0315301 | A1 | 12/2009 | Athalye | |
| 2010/0170761 | A1 | 7/2010 | Herold | |
| 2011/0247910 | A1 | 10/2011 | Darvish et al. | |
| 2014/0190780 | A1* | 7/2014 | Blazure | A45C 5/146<br>190/1 |
| 2015/0145223 | A1 | 5/2015 | Gregory | |
| 2015/0208776 | A1 | 7/2015 | Bennett | |

* cited by examiner

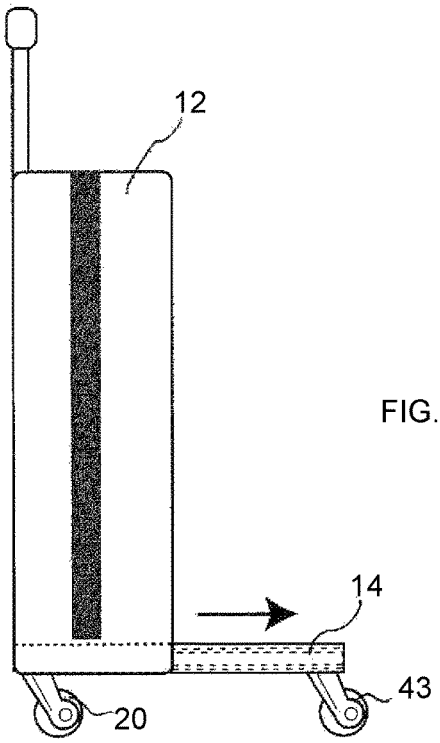
FIG. 26A
FIG. 26B
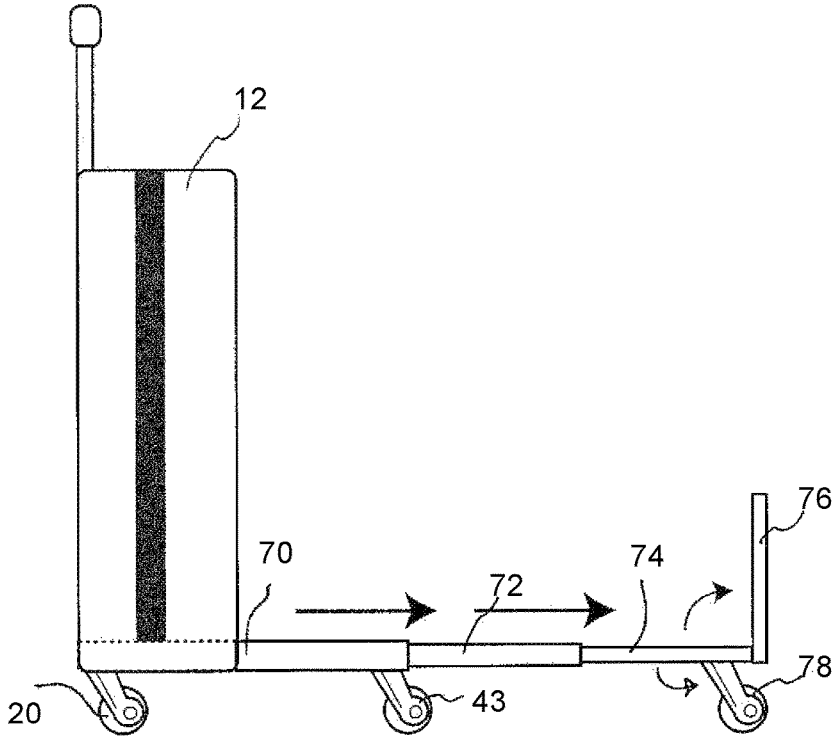

LUGGAGE SYSTEM WITH TRANSPORT PLATFORM

FIELD OF THE INVENTION

The invention relates to luggage transport systems and methods. In particular, the invention relates to a system for transporting two or more pieces of luggage together such that they can be easily maneuvered with one hand and transported on an escalator.

BACKGROUND OF THE INVENTION

Many travelers carry more than one suitcase or another piece of luggage through airports, trains, buses or hotels. Transporting more than one piece of luggage is often difficult, especially when the traveler has to use one of his or her hands to do other tasks, such as handle traveling tickets or hold a beverage cup. There are often transport carts available for transporting multiple pieces of luggage, but the carts typically require a fee, are bulky, and are not always practical to use. Additionally, airports, hotels and bus terminals often have multiple levels, requiring the traveler to transport luggage on an escalator, which further complicates handling of multiple pieces of luggage at the same time.

A number of prior art systems have been developed for transporting multiple pieces of luggage. However, while these known systems provide various ways of attaching pieces of luggage together for transport, they are often too cumbersome, heavy, difficult to assemble and/or expensive to manufacture, thus resulting in a higher cost for consumers. Additionally, the prior art luggage transport systems are not adapted for being transported on an escalator, requiring the traveler to balance the entire weight of multiple connected luggage pieces on one escalator step, which is challenging. Another difficulty with known luggage transport systems is placing them on and then taking them off an escalator. Travelers often operate the luggage system with only one hand, and it is difficult to correctly place the luggage system on an escalator step and then support it there such that it does not topple over.

SUMMARY OF THE INVENTION

Accordingly, it is an objective of the present invention to provide a luggage system that provides a simple and effective way of transporting multiple luggage pieces that is easy to assemble and operate.

It is also an objective of the present invention to provide a system for transporting multiple pieces of luggage that is specifically adapted for being easily transported on an escalator.

It is further an objective of the present invention to provide a luggage system for transporting multiple pieces of luggage that can be moved easily with one hand.

In order to overcome the deficiencies of the prior art and to achieve at least some of the objects and advantages listed, the invention comprises a luggage transport system, including a first piece of luggage, a transport platform movably coupled to the first piece of luggage, and at least one additional piece of luggage supported on the transport platform, wherein the transport platform is adapted to be elevated and lowered relative the first piece of luggage.

In some embodiments, the transport platform folds upward towards a wall of the first piece of luggage when not in use and folds downward when in use. In certain of these embodiments, the transport platform folds to a front wall of the first piece of luggage. In additional embodiments, the transport platform folds to a rear wall of the first piece of luggage. In further embodiments, the transport platform folds to one of sidewalls of the first piece of luggage.

In certain embodiments, the transport platform comprises a first part and a second part, wherein the second part is movable from a first position in which the second part is substantially parallel to the first part, to a second position, in which the second part is substantially perpendicular to the first part.

In some embodiments, the transport platform includes at least one wheel movably positioned on its bottom surface. In certain of these embodiments, the transport platform further includes a channel positioned on its bottom surface that movably engages the wheel such that the wheel is positioned under the first piece of luggage when the transport platform is not in use and is slid out and positioned under the transport platform when the platform is in use.

In certain embodiments, the first piece of luggage comprises a first attachment member and the transport platform comprises a second attachment member that movably engages the first attachment member. In some of these embodiments, the first attachment member comprises at least one channel and the second attachment member comprises at least one protrusion that slidably engages the at least one channel such that the first piece of luggage and the transport platform slide up and down with respect to each other. In additional embodiments, the first attachment member comprises one or more toothed channels and the second attachment member comprises one or more toothed wheels that movably engage the toothed channels such that the first piece of luggage and the transport platform move up and down relative each other.

In some cases, the first piece of luggage comprises two or more wheels.

In some embodiments, the first piece of luggage comprises a handle for transporting the luggage system.

The present invention further comprises a luggage transport system, including a first piece of luggage having a vertical axis, and a transport platform movably coupled to the first piece of luggage and adapted for supporting at least one additional piece of luggage when in a working position, wherein the transport platform is movable along the vertical axis of the first piece of luggage when in the working position.

In some embodiments, the first piece of luggage comprises a first attachment member and the transport platform comprises a second attachment member that movably engages the first attachment member. In certain of these embodiments, the first attachment member comprises one or more channels extending substantially parallel to the vertical axis of the first piece of luggage and having an opening on one side that is opposite a side that faces a wall of the first piece of luggage, wherein the channel opening has an inner diameter. In additional embodiments, the second attachment member comprises at least one protrusion positioned on the transport platform and slidably engaging the at least one channel such that the first piece of luggage and the transport platform slide up and down relative each other, wherein the protrusion has an outer diameter that is larger than the inner diameter of the channel opening.

In certain embodiments, the first attachment member comprises one or more channels extending substantially parallel to the vertical axis of the first piece of luggage and having two opposing sides, wherein at least one of the opposing sides has a plurality of teeth. In some of these embodiments, the first attachment member comprises a first channel positioned on one side wall of the first piece of luggage and a second channel positioned on the opposite side of the first piece of luggage. In additional embodiments, the second attachment member comprises one or more rotating wheels coupled to the transport platform and having a plurality of teeth corresponding to the plurality of teeth of the one or more channels, wherein the plurality of teeth of the one or more rotating wheels movably engage the plurality of teeth of the one or more channels such that the first piece of luggage and the transport platform move up and down with respect to each other.

In some cases, the transport platform is removably attached to the first piece of luggage.

In certain embodiments, the first piece of luggage has a bottom portion and the transport platform slides under the bottom portion of the first piece of luggage when not in use.

Other objects of the invention and its particular features and advantages will become more apparent from consideration of the following drawings and accompanying detailed description.

BRIEF DESCRIPTION OF THE DRAWINGS

FIGS. 26A-26C are side views of the luggage transport system of the present invention, showing a telescoping transport platform in different configurations.

DETAILED DESCRIPTION OF THE INVENTION

Figure 1A:
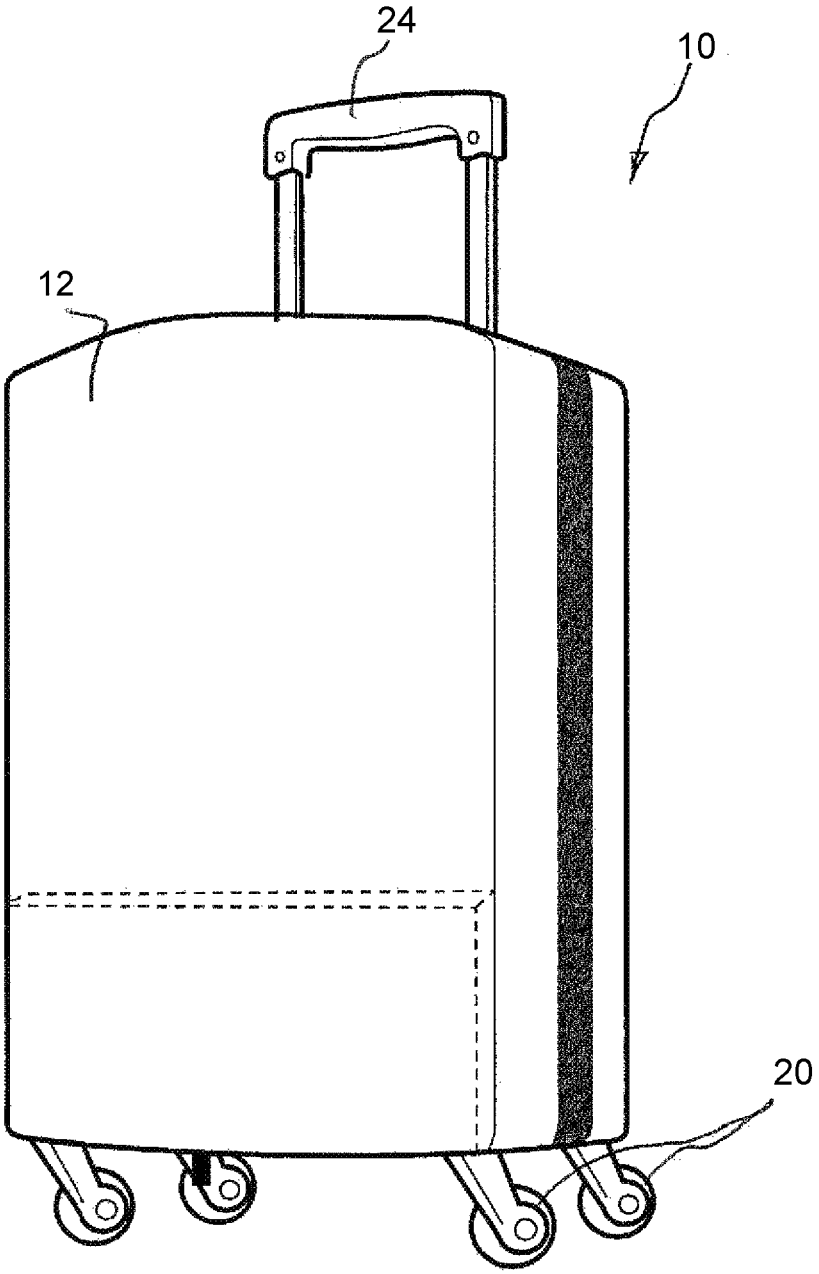
FIG. 1A is a front perspective view of the luggage transport system in accordance with the present invention.

The basic components of an exemplary embodiment of a luggage transport system in accordance with the invention are illustrated in FIG. 1A. As used in the description, the terms "top," "bottom," "above," "below," "over," "under," "above," "beneath," "on top," "underneath," "up," "down," "upper," "lower," "front," "rear," "back," "forward" and "backward" refer to the objects referenced when in the orientation illustrated in the drawings, which orientation is not necessary for achieving the objects of the invention.

The luggage transport system of the present invention is designed for transporting multiple pieces of luggage that are attached to each other so that they can be moved easily with one hand. This is achieved by providing a transport platform either removably or permanently attached to a first piece of luggage that supports one or more additional pieces of luggage. The present invention allows for the additional pieces of luggage to be elevated or lowered when riding on an escalator by moving the transport platform relative the first piece of luggage such that each piece of luggage rests on its own step. This distributes the weight of each piece of luggage across multiple steps, allowing a traveler to transport multiple pieces of luggage on an escalator without any hassle.

As illustrated in FIG. 1A, the luggage transport system 10 includes a first piece of luggage 12. The luggage piece 12 can be of any shape and/or size. In some embodiments, the luggage piece 12 has one or more sets of wheels 20 to facilitate transport of the luggage by the user by rolling it on the ground surface. In additional embodiment, the luggage piece 12 also includes a handle 24 that the user can grab to transport the luggage.

Figure 1B:
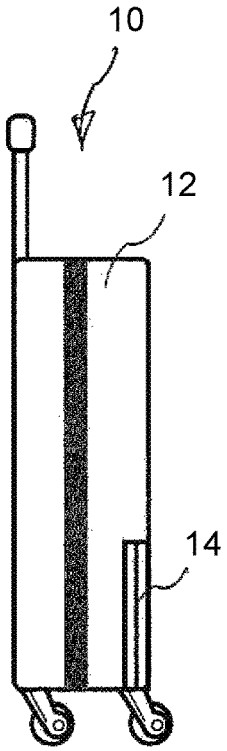
FIG. 1B is a side view of the luggage transport system of FIG. 1A, showing a transport platform in a non-working configuration.
Figure 1C:
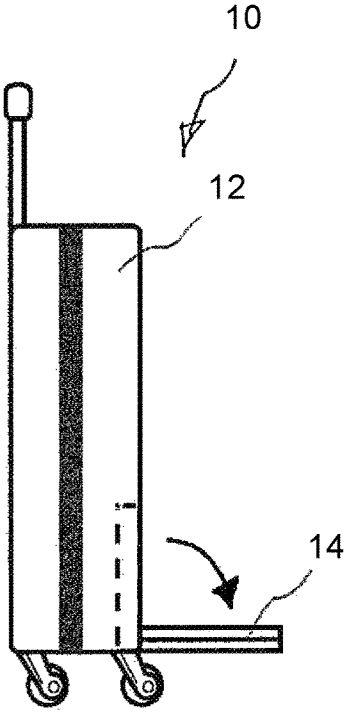
FIG. 1C is a side view of the luggage transport system of FIG. 1A, showing the transport platform being moved to a working configuration.
Figure 1D:
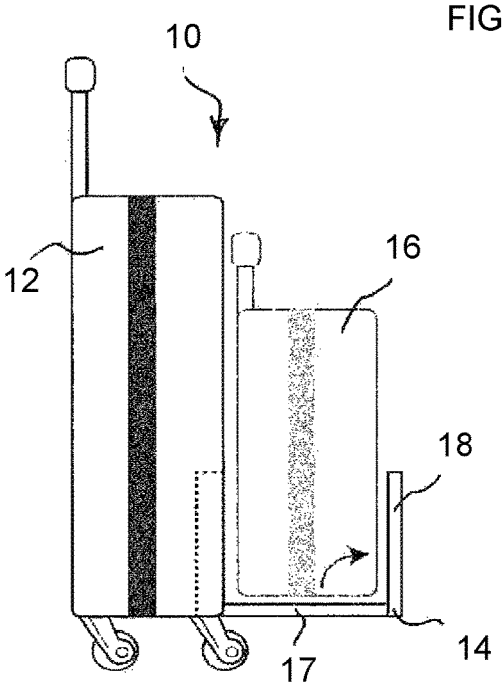
FIG. 1D is a side view of the luggage transport system of FIG. 1A, showing the transport platform in the working configuration supporting a second piece of luggage.

The luggage transport system 10 also includes a transport platform 14 movably attached to the luggage piece 12, as shown in FIGS. 1B-1D. The transport platform 14 is attached to the luggage 12 by any suitable mechanism, as described in more detail below. In some embodiments, the transport platform is permanently attached to the luggage piece 12. In other embodiments, the platform 14 can be removed from the luggage 12 when desired such that the luggage 12 can be used as a regular suitcase. The transport platform 14 is made with any suitable material, such as metal or plastic, that is lightweight but is durable enough to support additional pieces of luggage on the platform.

Figure 10:
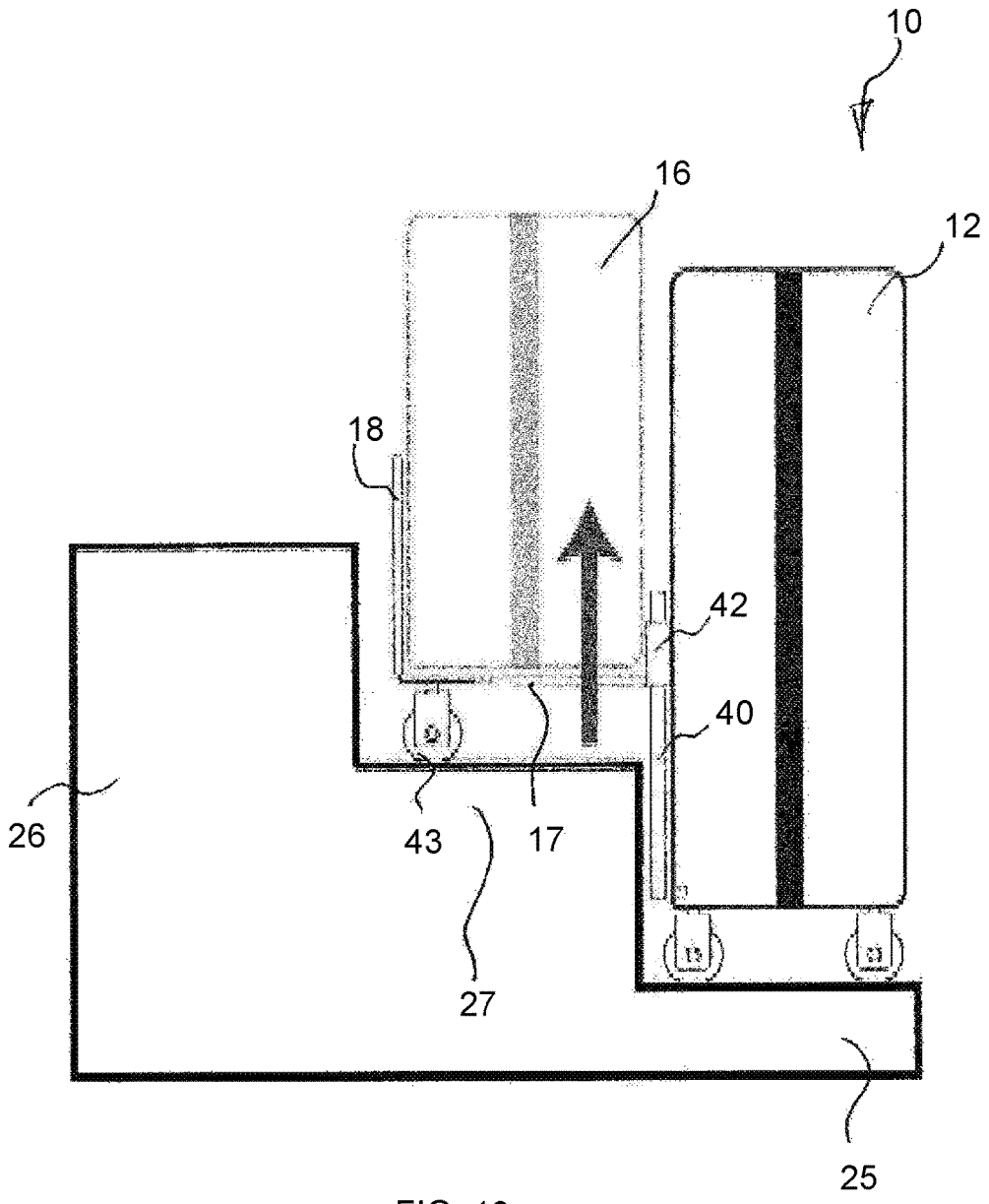
FIG. 10 is a side view of the luggage transport system of FIG. 7A, being transported on an escalator.

When the transport platform 14 is in a non-working configuration, it is folded upward such that it is positioned substantially parallel to the wall of the luggage piece 12, as shown in FIG. 1B. When it is desirable to use the transport platform 14, it is unfolded downward, as shown in FIG. 10, such that the platform 14 is substantially perpendicular to the wall of the luggage piece 12. The platform 14 has a first portion 17 and a second portion 18, which are pivotally connected to each other. Once the platform is unfolded perpendicular to the luggage wall, the second portion 18 is unfolded further such that it extends substantially perpendicular to the first portion 17 and substantially parallel to the luggage wall, as illustrated in FIG. 1D. Then, one or more additional pieces of luggage 16 can be placed on the first portion 17 of the platform 14, and the second portion 18 functions to secure the luggage 16 on the platform such that it does not slide off the platform. The transport platform 14 may be provided with additional means for securing the luggage 16 on the platform, such as, e.g., belts or other fasteners that extend round the luggage 16.

It is noted that, while FIGS. 1A-1D show the transport platform 14 being attached to the front wall of the luggage piece 12, it can also be attached to the back wall or either side wall of the luggage piece, as described in more detail below. It is also understood that the platform 14 may have only one portion 17 that supports the additional pieces of luggage, without the second portion 18. It is further noted that the transport platform 14 may have one or more wheels attached to its bottom, as described below.

The transport platform 14 is movably coupled to the first piece of luggage 12 via any suitable mechanism, some exemplary embodiments of which are described below, that allows the transport platform 16 to move up and down relative the luggage piece 12. This allows the transport platform with the additional luggage to be elevated or lowered when riding on an escalator such that the first luggage piece 12 and the additional luggage piece 16 each rest on their own escalator step. This distributes the weight of each piece of luggage across multiple steps, allowing a traveler to transport multiple pieces of luggage on an escalator without any hassle.

Figure 2A:
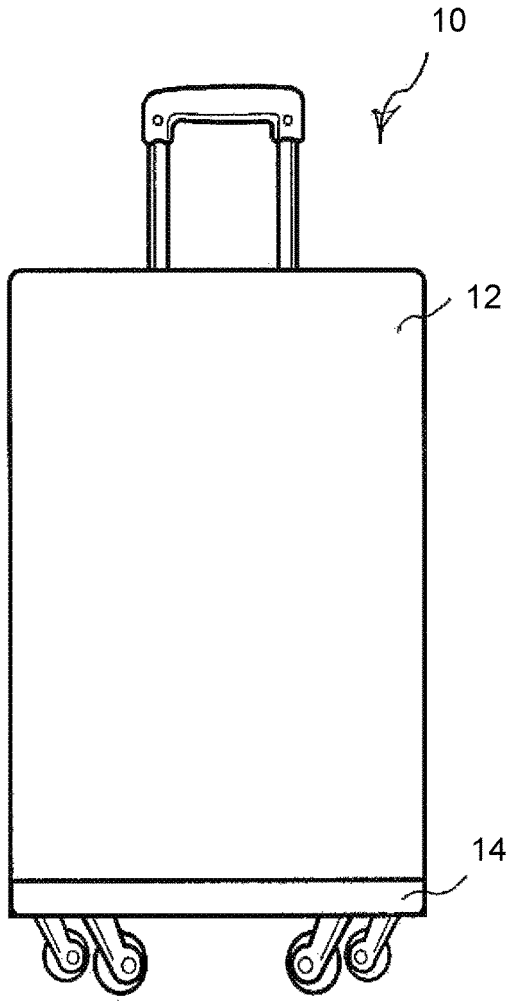
FIG. 2A is a front view of another embodiment of the luggage transport system in accordance with the present invention.
Figure 2B:
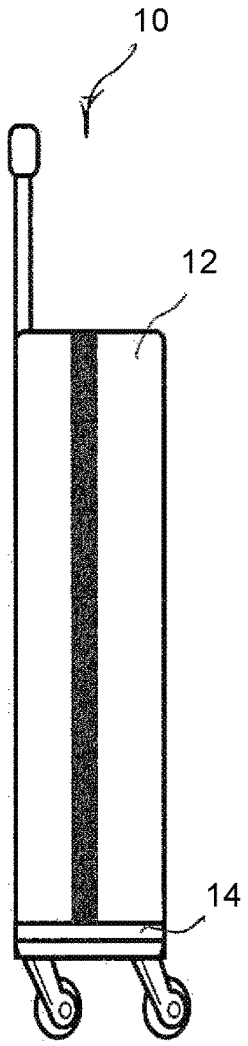
FIG. 2B is a side view of the luggage transport system of FIG. 2A, showing a transport platform in a non-working configuration.
Figure 2C:
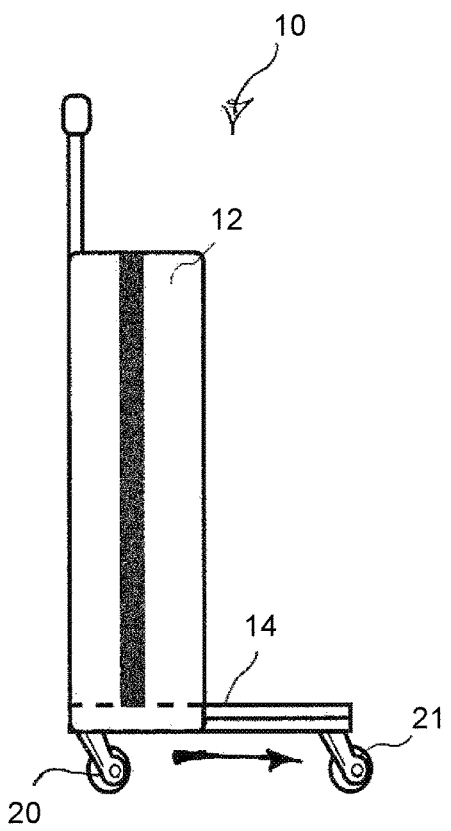
FIG. 2C is a side view of the luggage transport system of FIG. 2A, showing the transport platform being moved to a working configuration.

FIGS. 2A-2D illustrate another exemplary embodiment of the luggage transport system of the present invention. In this embodiment, the transport platform 14 slides under the bottom of the first luggage piece 12 when in a non-working configuration, instead of being folded up to the luggage wall. When it is desired to use the transport platform 14, it is pulled out from under the luggage 12, as shown in FIG. 2C. The platform has one or more wheels 21 positioned on its bottom side that facilitate sliding of the platform and also distribute the weight of the platform and additional luggage supported therein. The platform 14 is attached to the luggage piece 12 via any suitable mechanism that allows the platform to slide in and out from under the luggage piece 12. For example, the bottom of the luggage 12 may have one or more channels, and the transport platform 14 may have one or more corresponding protrusions or wheels that slide inside the channels. It is understood that any other suitable mechanism may also be used.

Figure 2D:
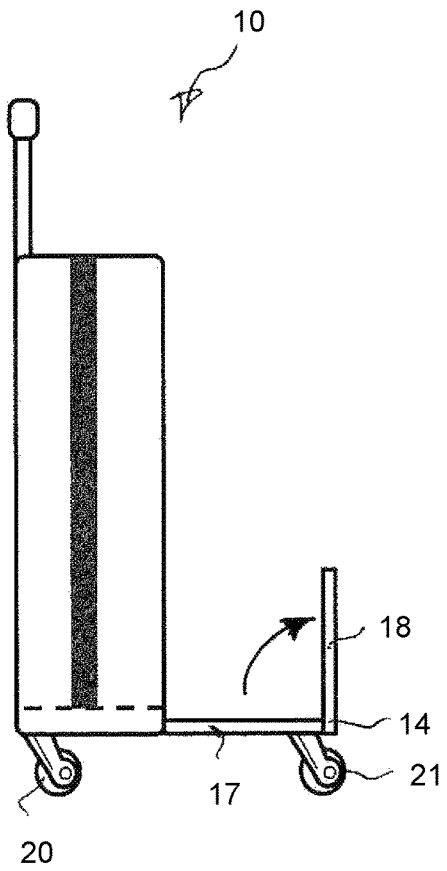
FIG. 2D is a side view of the luggage transport system of FIG. 2A, showing the transport platform in the working configuration.

Once the platform 14 is slid out from under the luggage piece 12, its first portion 17 remains substantially parallel with the bottom of the luggage and its second portion 18 is unfolded such that it extends substantially perpendicular to the first portion 17 and substantially parallel to the luggage wall, as illustrated in FIG. 2D. One or more additional pieces of luggage are then placed on first portion 17 of the platform 14 between the luggage wall and the second portion of the platform 18. As mentioned above, it is understood that the platform may only have the base portion 17 without the unfolding portion 18.

Figure 3A:
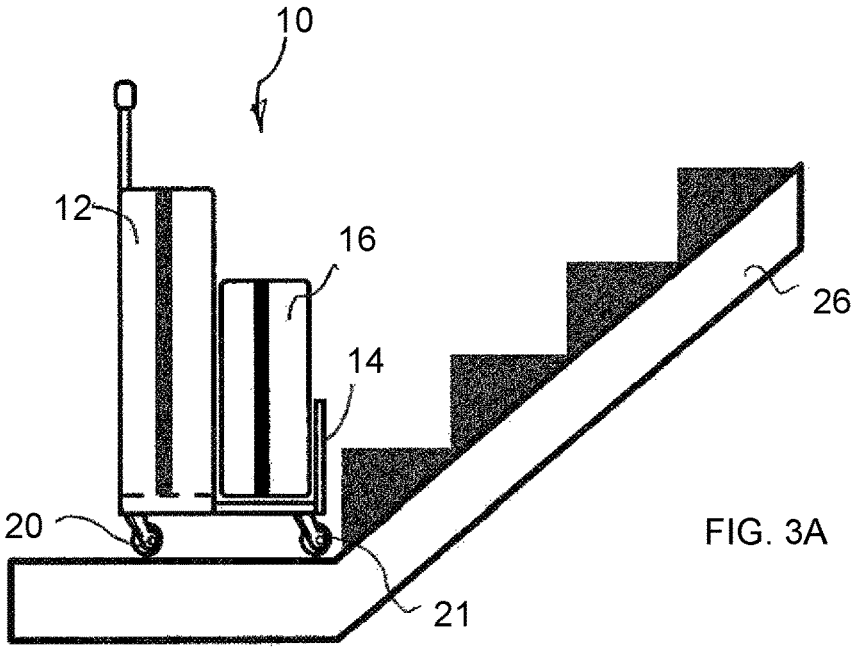
FIGS. 3A and 3B illustrate the luggage transport system of FIG. 2A being transported on an escalator.
Figure 3B:
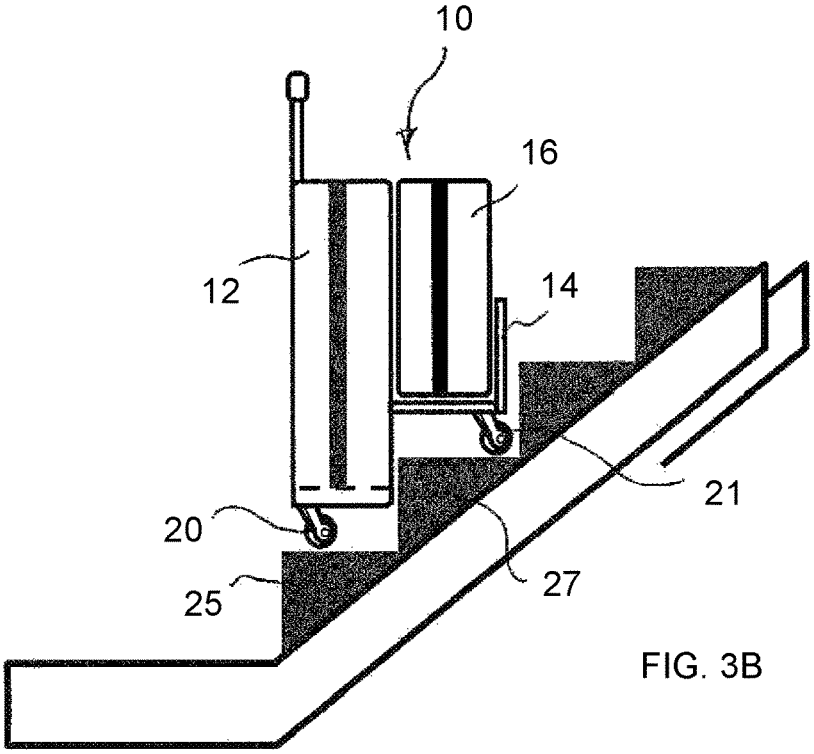

FIGS. 3A and 3B illustrate the luggage transport system 10 being transported on an escalator 26. The luggage transport system 10 with the transport platform 14 supporting the additional piece of luggage 16 is brought to the bottom of the escalator 26. At this point, the bottom of the first luggage piece 12 and the bottom of the transport platform 14 are substantially lined up. Then, the luggage system 10 is pushed onto the escalator 26 such that the wheels 20 of the first luggage piece 12 rest on one escalator step 25 and the wheels 21 of the transport platform 16 rest on an adjacent escalator step 27 ahead of the step 25. As the escalator 26 begins to ascend, the step 27 is elevated relative the step 25. Consequently, the transport platform 14 with the additional luggage second piece of luggage 16 resting on the second step 27 is elevated relative the first piece of luggage 12 resting on the first step 25, as shown in FIG. 3B. This is made possible by a movable attachment between the first piece of luggage 12 and the transport platform 16, as described in more detail below.

Once the luggage system 10 reaches a top of the escalator 26, the steps 25 and 27 become leveled again. The transport platform 14 slides downward relative the luggage piece 12, such that the bottoms of the luggage piece 12 and the transport platform 14 become substantially leveled. The luggage system 10 can then be easily moved from the escalator to the ground by maneuvering it via the handle 24.

It is understood that the luggage transport system 10 can be transported down the escalator in the same manner as described above. In particular, the luggage system is brought to the top of the escalator and is placed on the escalator steps, with the luggage piece 12 being placed on a step that is below the step on which the transport platform 14 rests. As the escalator begins to descend, the transport platform 14 is raised relative the luggage piece 12 such that each rests on its own escalator step. When the system reaches the bottom of the escalator, the transport platform is lowered relative the luggage piece such that the system can be easily wheeled off the escalator and transported on the ground.

Figure 3C:
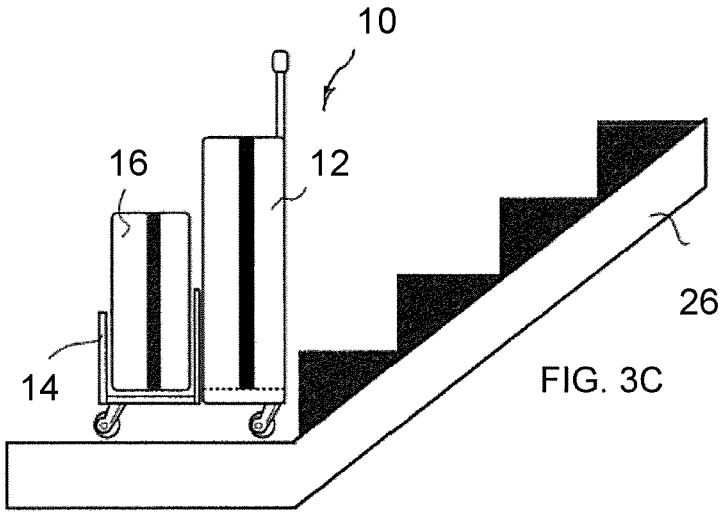
FIGS. 3C and 3D illustrate another embodiment of the luggage transport system of the present invention being transported on an escalator.
Figure 3D:
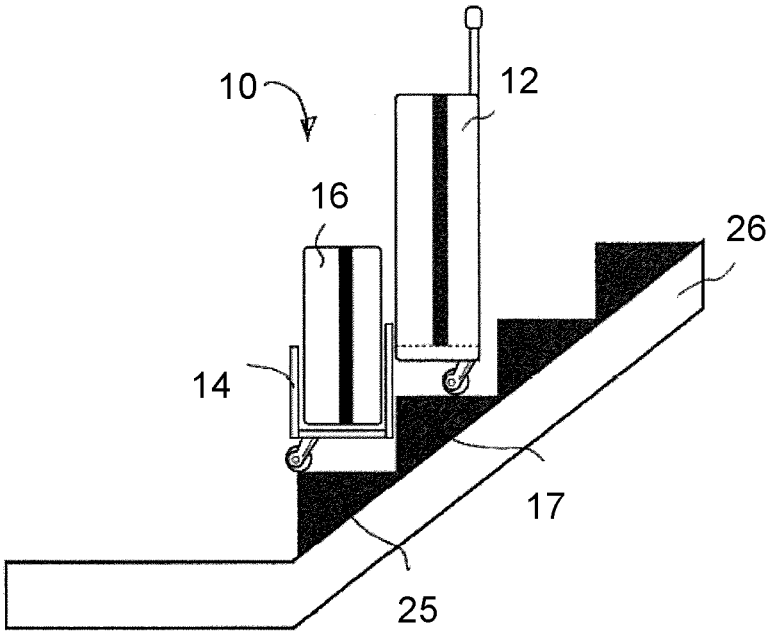

It is further understood that in other exemplary embodiments, such as shown in FIGS. 3C and 3D, the transport platform 14 may be lowered relative the luggage piece 12 when transported on the escalator. In particular, the user may want to wheel the system 10 behind them, as opposed to pushing it in front of them. This way, the luggage piece 12 is placed on the escalator step 27 ahead of the transport platform 14 with the additional luggage 16. As the escalator begins to ascend, the luggage piece 12 is elevated relative the transport platform 14, as illustrated in FIG. 3D. This may be achieved by using any of the exemplary coupling systems between the luggage piece 12 and the transport platform 14, as described above and also below. For example, the transport platform may have male attachment members, e.g. rods, that slide inside female attachment members, e.g., rings or apertures, provided on the luggage piece. Any other suitable coupling mechanism may be used. The same motion of the transport platform 14 relative the luggage piece 12 may be utilized when transporting the luggage system 10 down the escalator, with the transport platform being placed on the escalator step first and being lowered with respect to the luggage piece 12 as the escalator descends.

While the transport platform 16 is shown as having wheels 21, it is understood that in some embodiments, such as discussed above with respect to FIGS. 1A-1D, the platform does not have wheels. In these embodiments, the platform 14 may rest directly on the escalator step.

Figure 4A:
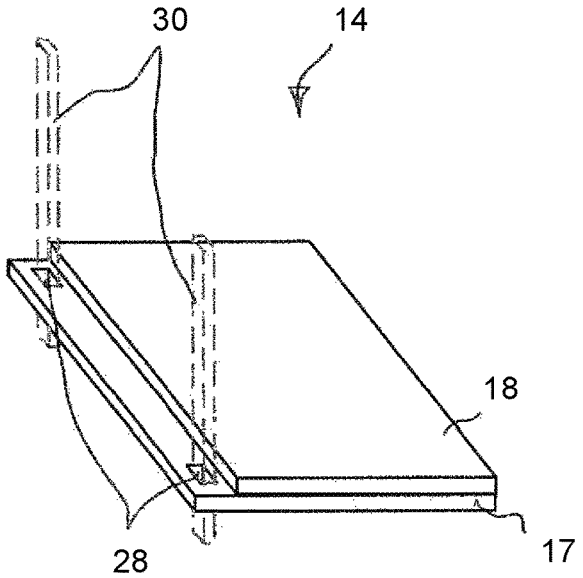
FIGS. 4A-4C are partially schematic side perspective views of the transport platform of the luggage system of the present invention in various configurations.
Figure 4B:
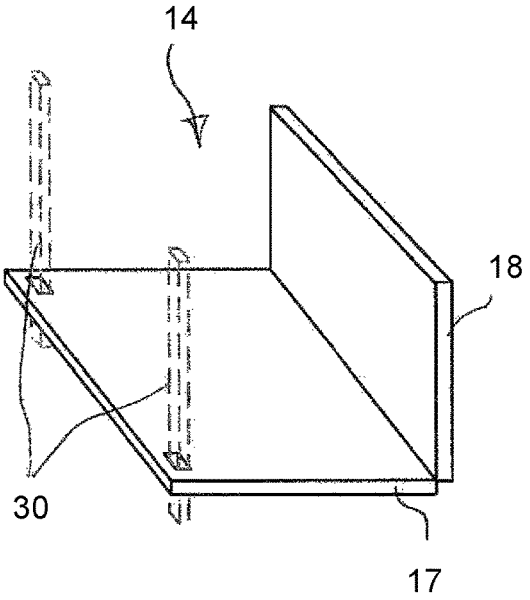
Figure 4C:
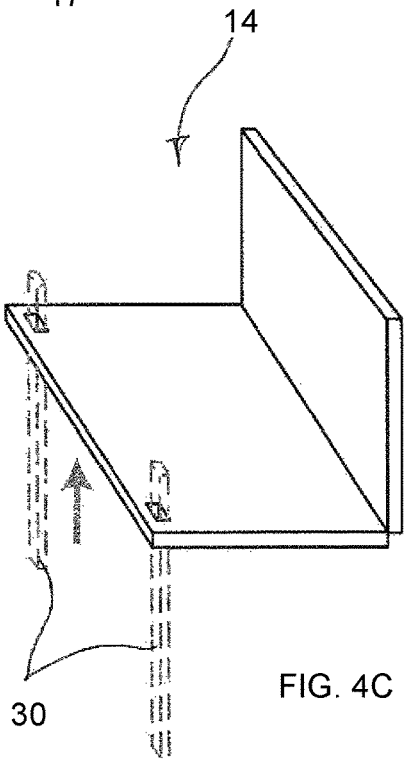
Figures 5A, 5B, 5C:
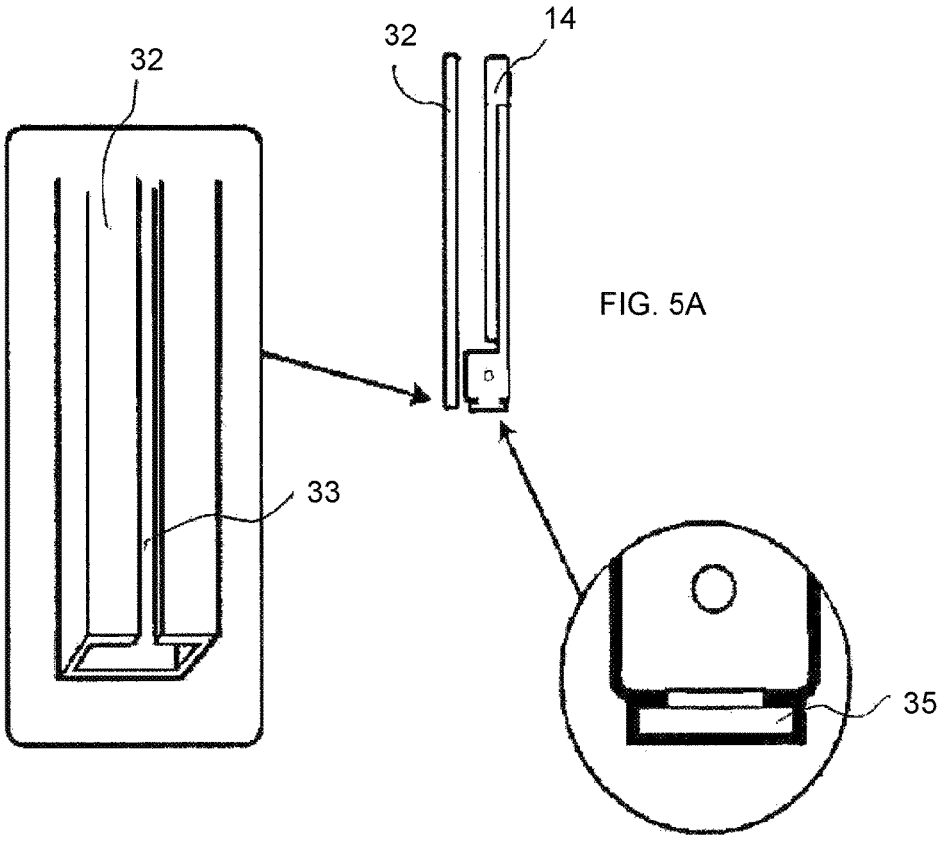
FIG. 5A is a partially schematic side view of the transport platform and an attachment member of the luggage system of the present invention.
FIG. 5B is an enlarged partial front perspective view of the attachment member of FIG. 5A.
FIG. 5C is an enlarged partial front view of the transport platform of FIG. 5A.

One exemplary way of movably attaching the transport platform to the luggage piece is shown in FIGS. 4A-4C. The first portion 17 of the platform 14 has two or more apertures 28 positioned on a side of the platform adjacent the wall of the first luggage piece 12. The luggage piece 12 has two or more corresponding elongated attachment members 30 (shown in dashed lines) positioned on its wall adjacent the platform 14. The attachment members 30 may have any suitable size and shape that corresponds to the size and shape of the apertures 28 in the platform 14 such that the members 30 can be inserted into the apertures 28. The attachment members 30 are coupled to the first piece of luggage 12 via any suitable means that allow for the platform 14 to move up and down relative the luggage piece 12.

When in use, the second portion 18 of the transport platform is folded out from its initial position shown in FIG. 4A into a working position shown in FIG. 4B, such that an additional piece of luggage can be placed on the portion 17 between the portion 18 and the first luggage piece 12. When the luggage transport system is placed on an escalator, the transport platform 14 with the additional luggage slides upward relative the first luggage piece 12, as described above. This is achieved by the attachment members 30 of the luggage piece 12 sliding inside the openings 28 in the platform 14. When the luggage system reaches the top of the escalator, the platform 14 slides down the attachment members 30 via the openings 28 such that the platform is brought back in level with the bottom of the luggage piece 12, such that the entire system can be easily transported on the ground.

FIGS. 5A-5C and 6A-6D illustrate another exemplary way of movably attaching the transport platform to the luggage piece. In this embodiment, the attachment member 32 coupled to the luggage piece 12 (not shown) is in a form of an elongated channel that extends along a vertical axis of the luggage piece 12. One or more elongaged channels may be provided, as desirable. The channel 32 is made with any suitable material, e.g. metal or plastic, and may have different dimensions and shapes. The channel 32 is permanently or removably coupled to a wall of the luggage piece 12 by any suitable method, e.g., by gluing, sewing, molding, or stapling it to the wall of the luggage piece or by a snap-type or press-fit type connector. The channel 32 is C-shaped with an elongated opening 33 that extends substantially along the entire length of the channel 32. The opening 33 is provided on the channel side that faces away from the wall of the luggage piece 12. It is understood, however, that the elongated channels may have a different shape.

Figure 6A:
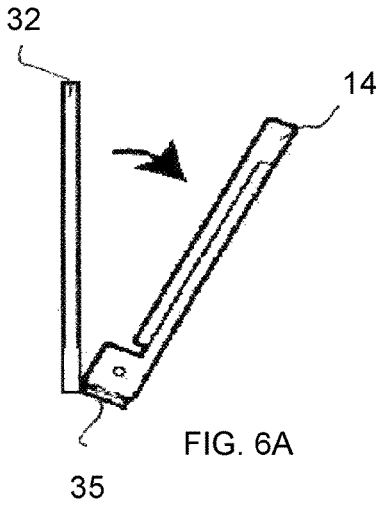
FIGS. 6A-6D are partially schematic side views of the transport platform and the attachment member of FIG. 5A, shown in various configurations.
Figure 6B:
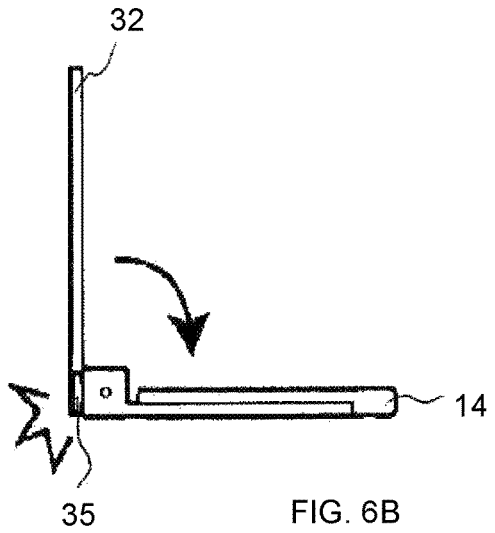
Figure 6C:
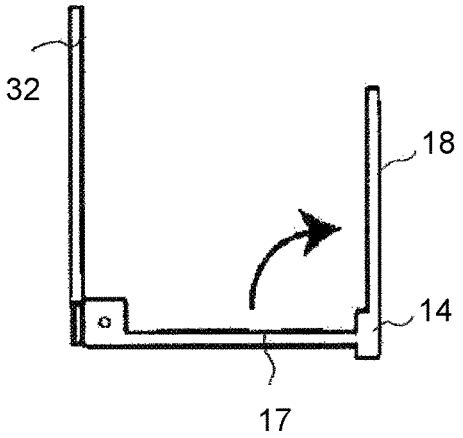
Figure 6D:
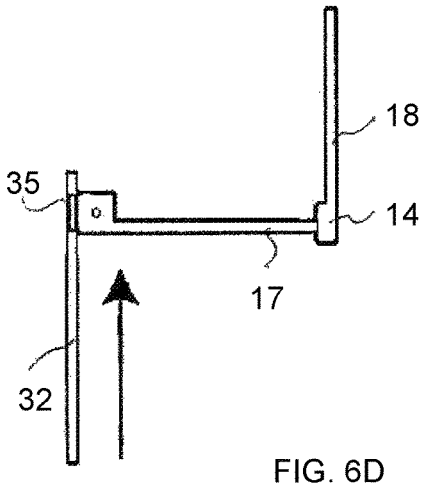

The transport platform 14 has one or more protrusions 35 that correspond to the elongated channel 32. In particular, a wider terminal portion of the protrusion 35 fits inside the channel 32 such that it can slide inside the channel through the opening 33. When the transport platform 14 is unfolded from its non-working configuration, as shown in FIG. 6A, the protrusion 35 is inserted into the channel 32, as shown in FIG. 6B. Then, the second portion 18 of the platform 14 is unfolded such that it extends substantially perpendicular to the first portion 17 and substantially parallel to the channel 32, as illustrated in FIG. 6C. One or more additional pieces of luggage are then placed on first portion 17 of the platform 14 between the channel 32 and the second portion of the platform 18. Once the luggage system is placed on the escalator, the transport platform 14 is elevated or lowered relative the luggage piece 12 by sliding the protrusion 35 inside the channel 32, as shown in FIG. 6D.

Figure 7A:
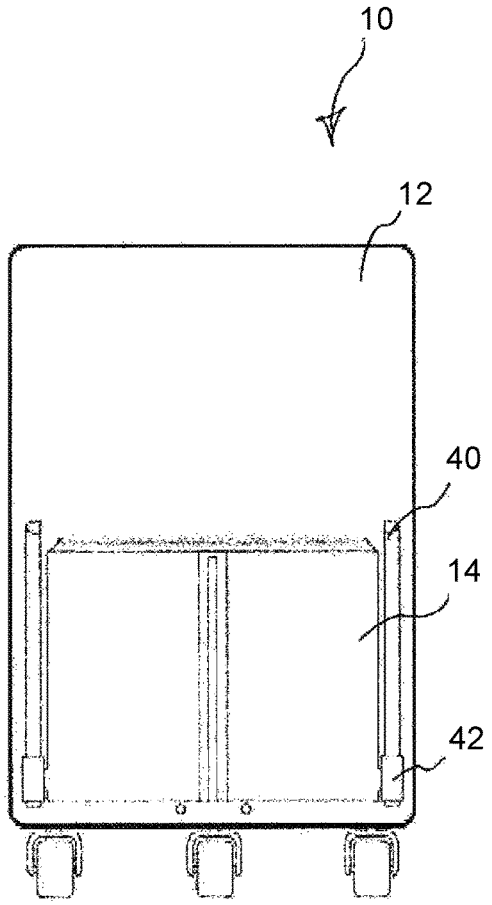
FIG. 7A is a front view of another embodiment of the luggage transport system in accordance with the present invention.
Figure 7B:
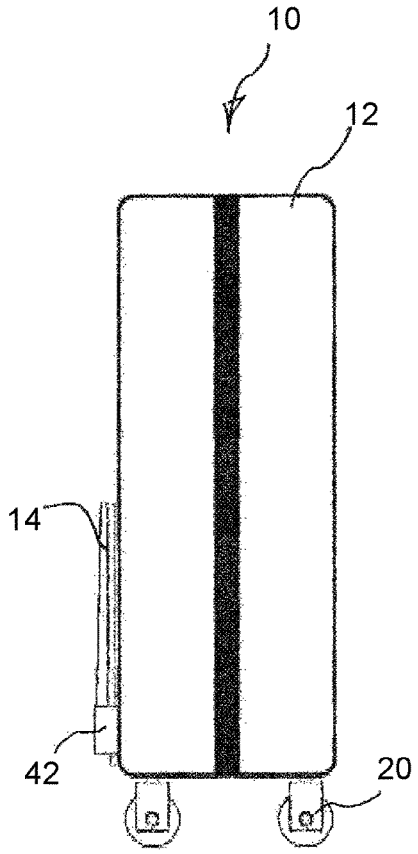
FIG. 7B is a side view of the luggage transport system of FIG. 7A, showing a transport platform in a non-working configuration.

Other coupling mechanisms for movably attaching the transport platform to the piece of luggage are also envisioned. For example, as shown in FIGS. 7A and 7B, the piece of luggage 12 has two or more male attachment members 40, e.g. elongated rods, coupled to the wall of the luggage piece. The transport platform 14 has two or more female attachment members 42, e.g. cylindrical pieces, that slide over the male attachment members 40.

Figure 8A:
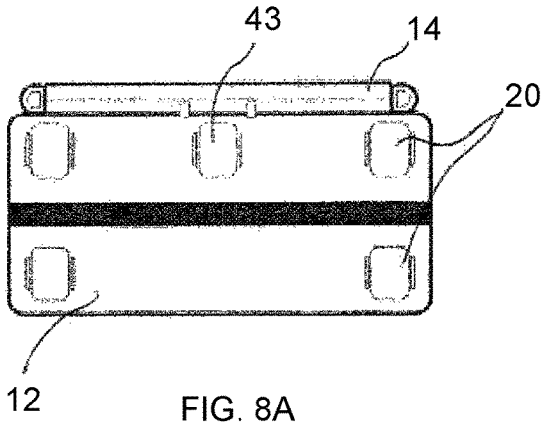
FIGS. 8A-8C are bottom views of the luggage transport system of FIG. 7A, showing the transport platform in various configurations.
Figure 8B:
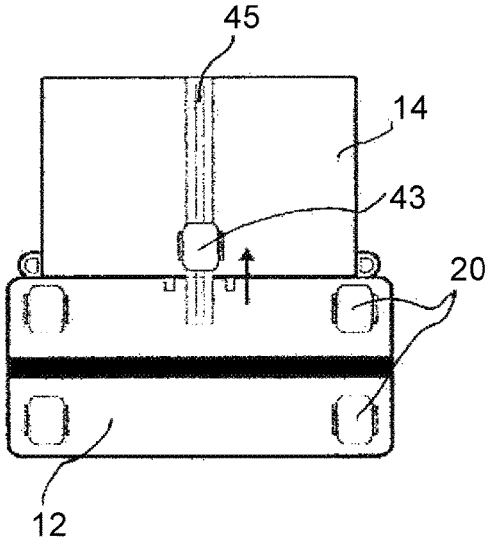
Figure 8C:
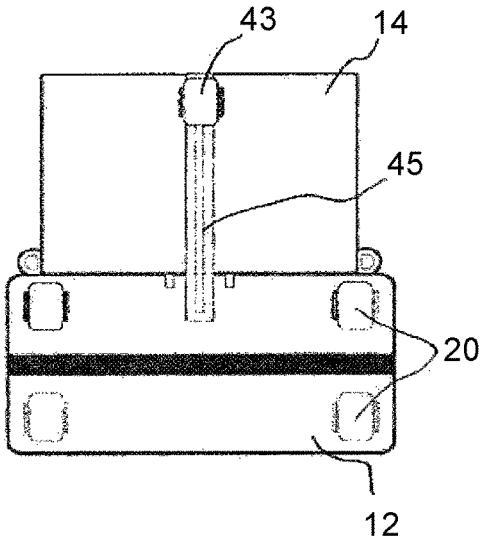

The bottom of the luggage piece 12 has four main wheels 20 and an additional movable wheel 43, as shown in FIG. 8A. The bottom side of the transport platform 14 has a channel 45 that slidably accommodates the additional wheel 43, as illustrated in FIG. 8B. Once the platform 14 is \folded down to its working configuration, the wheel 43 slides into the channel 45 such that the wheel 43 can be positioned underneath the transport platform 14, as shown in FIG. 8C. This way, the weight of the platform with the additional luggage supported thereon is distributed to the additional wheel 43 making the luggage system more stable and easier to maneuver.

Figures 9A, 9B, 9C:
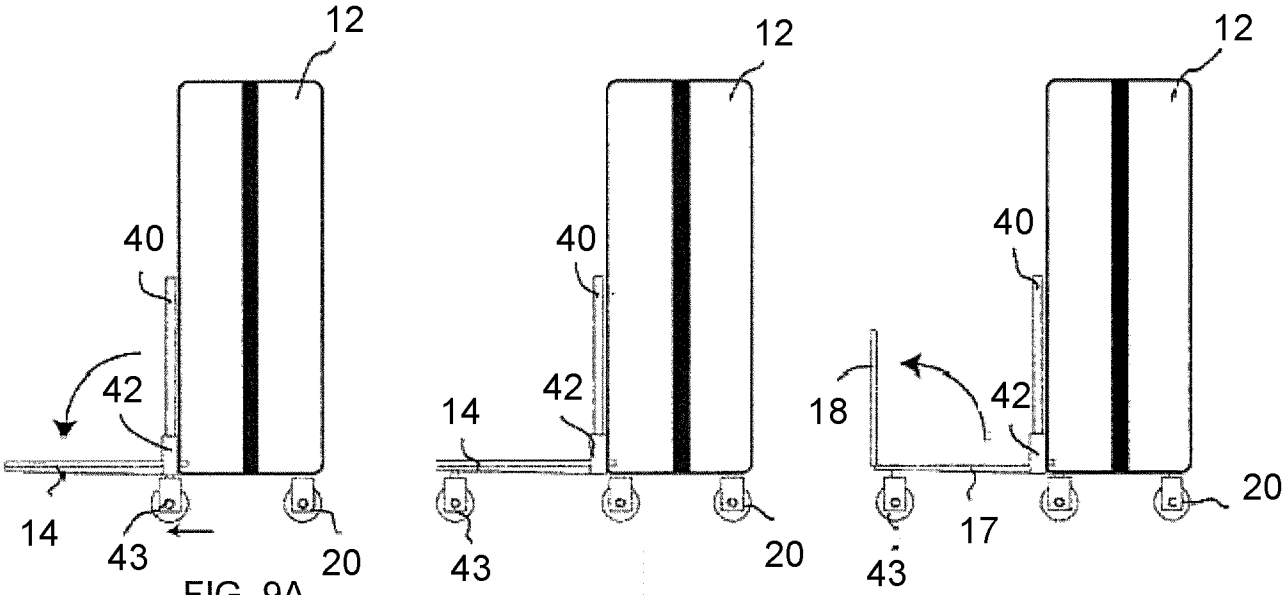
FIGS. 9A-9C are side views of the luggage transport system of FIG. 7A, showing the transport platform being moved from a non-working configuration to a working configuration.

When the transport platform 14 is in its non-working configuration, it is folded upwards to the wall of the luggage piece 12, as shown in FIGS. 7A-7B. When in use, the transport platform 14 is unfolded down, as illustrated in FIG. 9A, such that it is substantially parallel with the bottom of the luggage piece 12. This is made possible by a pivotable connection between the platform 14 and the female attachment members 42 that allow the platform to pivot down while the female attachment members 42 remain coupled to the male attachment members 40 of the luggage piece 12. Next, the additional wheel 43 is slid along the channel 45 and is positioned underneath the transport platform 14, as shown in FIG. 9B. Then, the second portion 18 of the platform 14 is unfolded such that it is substantially perpendicular to the first portion 17 and substantially parallel to the luggage piece 12, as illustrated in FIG. 9C, and an additional piece of luggage is placed on the platform between the second portion 18 and the luggage piece 12.

As shown in FIG. 10, when the luggage system 10 is placed on the escalator 26, the wheels 20 of the luggage piece 12 rest on the first step 25 and the wheel 43 of the transport platform 14 rests on the second step 27. As the steps move, the female attachment members 42 slide over the male attachment members 40, which allows the transport platform 14 to be elevated relative the luggage piece 12.

Figure 11C:
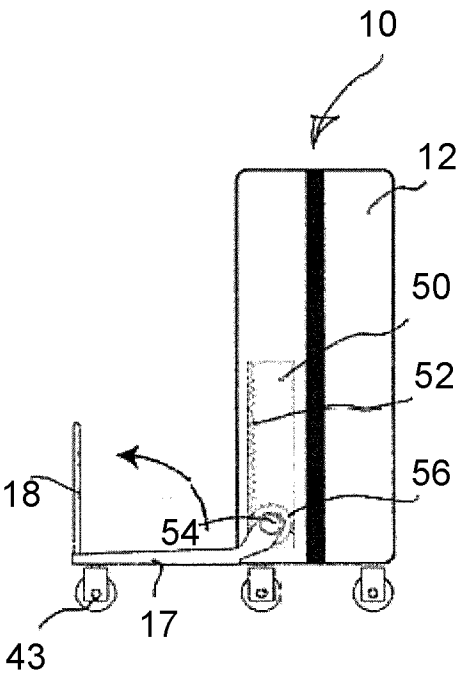
FIGS. 11A-11C are side views of an additional embodiment of the luggage transport system of the present invention, showing the transport platform being moved from a non-working configuration to a working configuration.
Figure 11B:
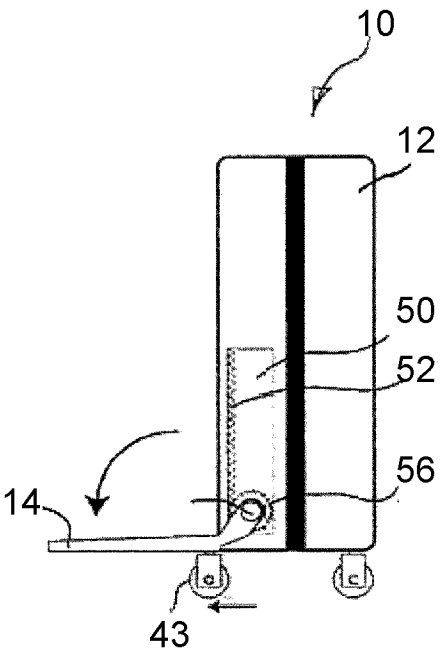
Figure 11A:
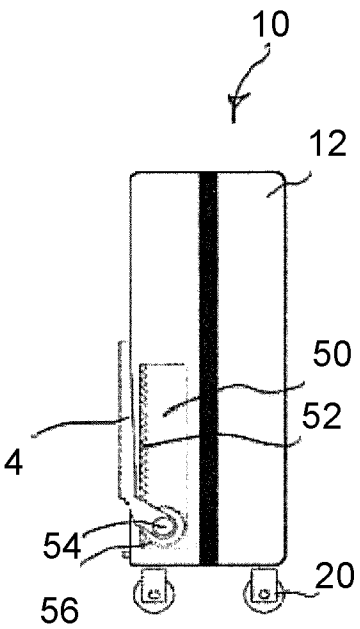

Another exemplary embodiment of the attachment mechanism is shown in FIGS. 11A-11C. In this embodiment, the luggage piece 12 has two elongated channels 50 that extend vertically along the side walls of the luggage piece 12. One or both sides of the channels 50 have a plurality of teeth 52. The transport platform 14 has two rotating wheels 54 positioned on opposing sides of the platform adjacent the luggage piece 12. Each wheel 54 has a plurality of teeth 56. The transport platform 14 is coupled to the luggage piece 12 by positioning the wheels 54 inside the channels 50 and engaging the plurality of teeth 52 with the plurality of teeth 56, as shown in FIG. 11A, which illustrates the platform 14 in a non-working configuration being folded upwards to the luggage wall.

When in use, the transport platform 14 is folded down, as illustrated in FIG. 11B. The platform 14 is pivotally attached to the toothed wheels 54 such that the platform can be pivoted down to its working position shown in FIG. 11B, while the wheels 54 remain engaged in the channels 50. The second portion 18 of the platform 14 is then further unfolded away from the first platform portion 17, as shown in FIG. 11C, to accommodate an additional piece of luggage.

Figure 12A:
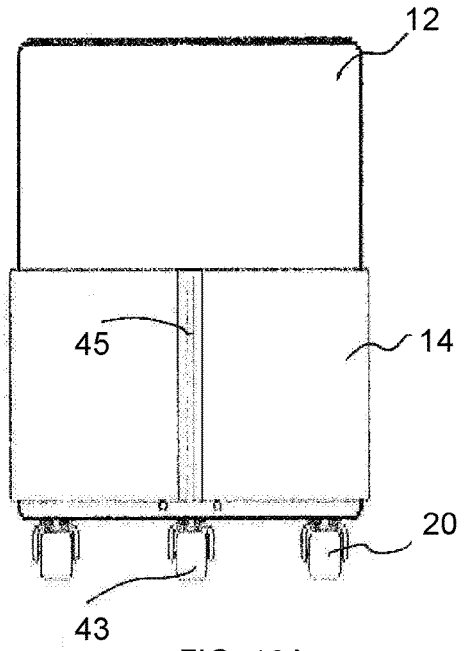
FIG. 12A is a front view of the luggage transport system of FIGS. 11A-11C.
Figure 12B:
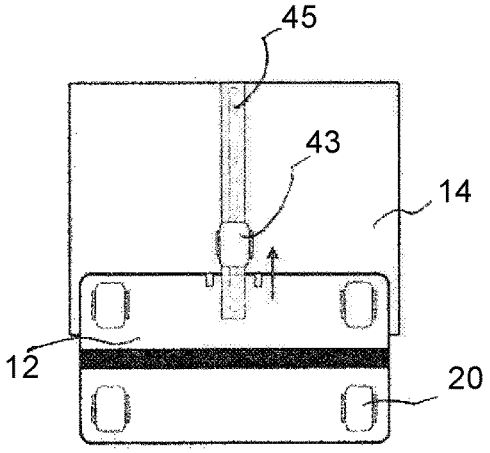
FIGS. 12B-12C are bottom views of the luggage transport system of FIGS. 11A-11C, showing the transport platform in various configurations.
Figure 12C:
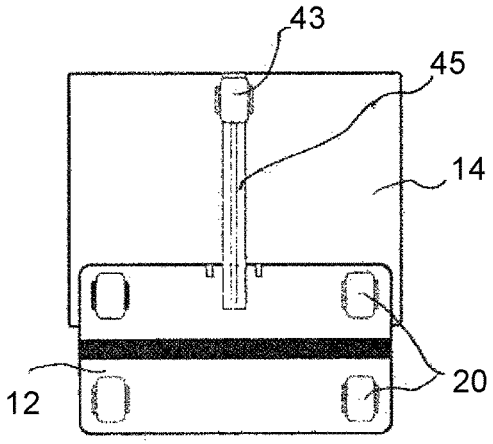

Similar to the embodiment shown in FIGS. 8A-8C, the bottom of the luggage piece 12 has a movable wheel 43, as illustrated in FIGS. 12A-12C. When the transport platform 14 is unfolded to its working configuration, the wheel 43 slides in the channel 45 provided on the bottom surface of the platform 14 and is positioned underneath the platform 14 to provide additional stability to the luggage system.

Figure 13:
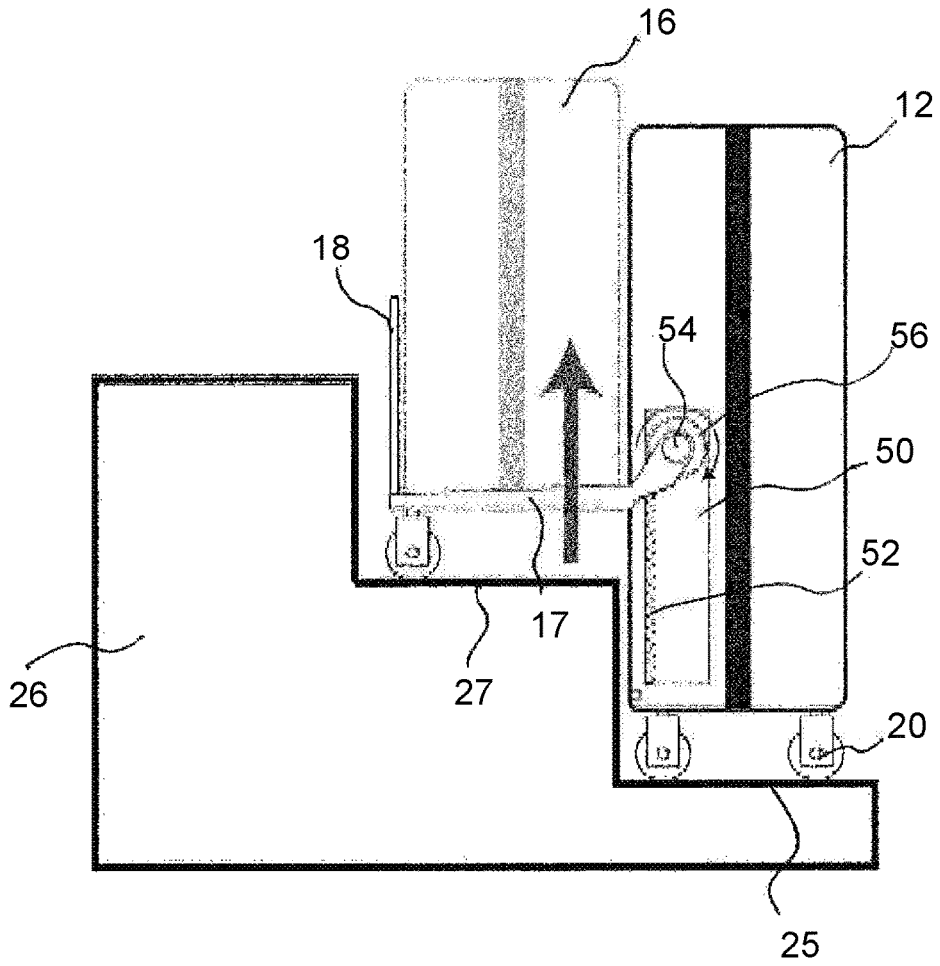
FIG. 13 is a side view of the luggage transport system of FIGS. 11A-11C, being transported on an escalator.

When the luggage system is placed on the escalator 26, the transport platform 14 resting on the first step 27 moves relative the luggage piece 12 resting on the second step 25 along the vertical axis of the luggage piece 12, as seen in FIG. 13. This is accomplished by engaging the plurality of teeth 52 of the elongated channels 50 with the plurality of teeth 56 of the wheels 54, such that the rotation of the wheels 54 within the channels 50 moves the transport platform 14 up and down relative the luggage piece 12.

Figure 14A:
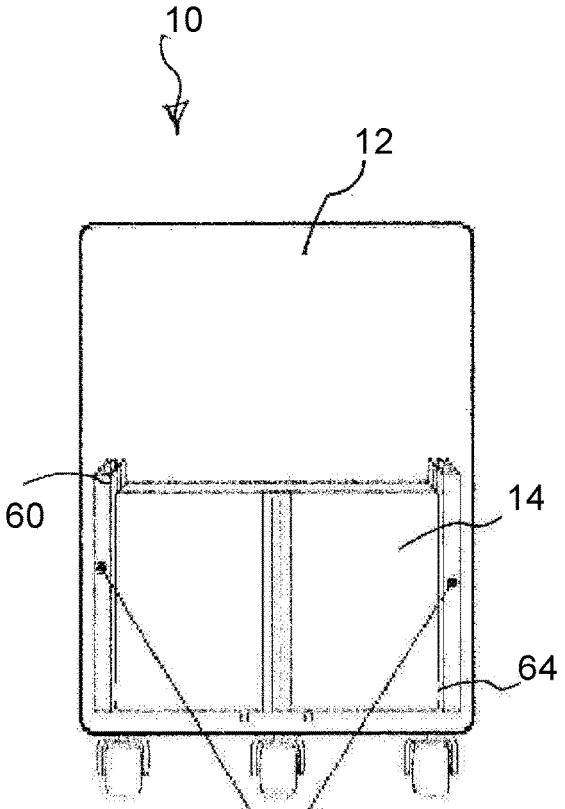
FIG. 14A is a front view of another embodiment of the luggage transport system of the present invention, showing the transport platform in a non-working configuration.
Figure 14C:
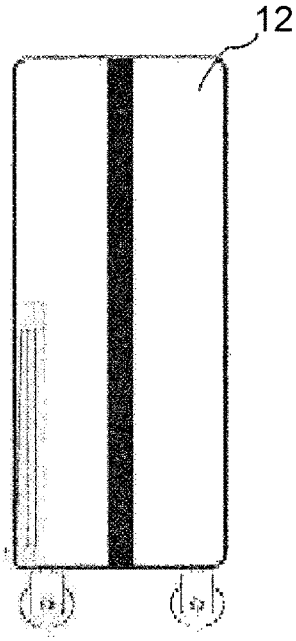
FIG. 14C is a side view of the luggage transport system of FIG. 14A.
Figure 14B:
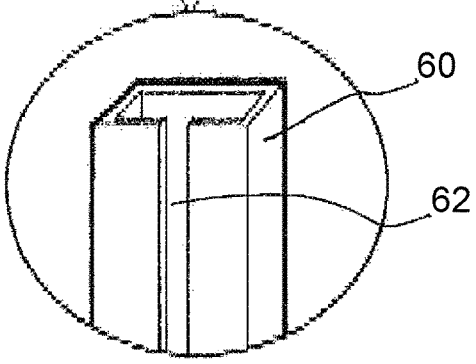
FIG. 14B is an enlarged partial front perspective view of an attachment member of the luggage transport system of FIG. 14A.

FIGS. 14A-14C illustrate yet another embodiment of the transport attachment mechanism. As shown in FIG. 14A, the luggage piece 12 has at least two elongated vertically extending channels 60, each positioned adjacent a side wall of the luggage piece. Each of the channels has an elongated opening 62, as seen in FIG. 14B, positioned on the sides of the channels 60 that face each other and the transport platform. The channels 60 are spaced apart such that the transport platform 14 is fitted between the channels 60. The transport platform 14 has at least two protrusions 64, each positioned on the side of the platform facing one of the channels 60. The protrusions 64 are movably engaged inside the channels 60 to couple the transport platform 14 to the luggage piece 12.

Figure 15C:
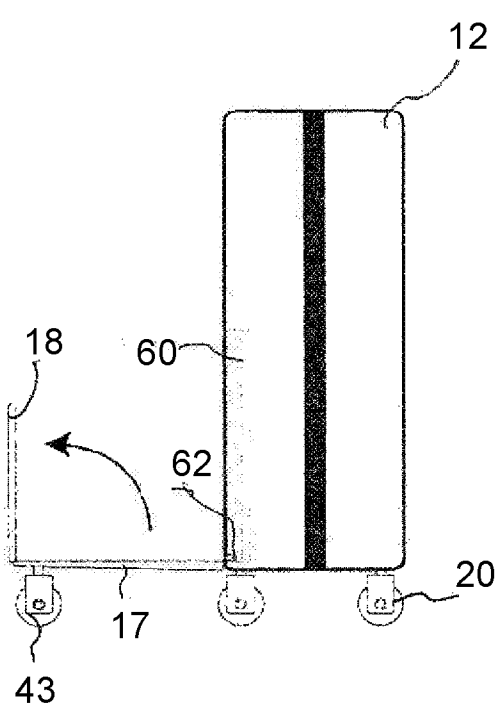
FIGS. 15A-15C are side views of the luggage transport system of FIG. 14A, showing the transport platform being moved from a non-working configuration to a working configuration.
Figure 15B:
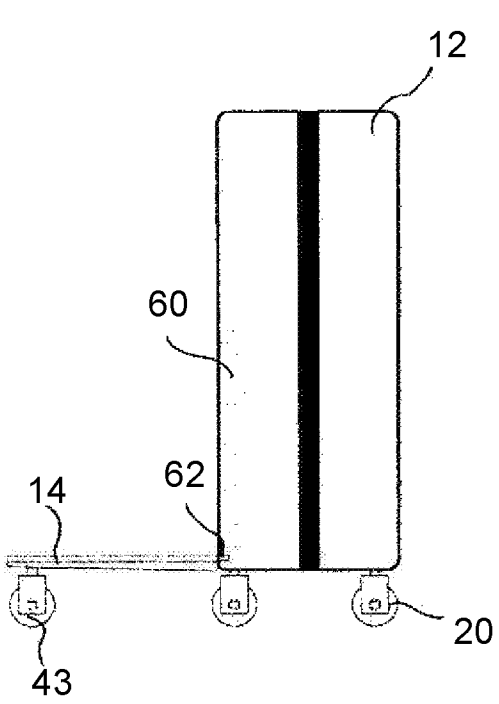
Figure 15A:
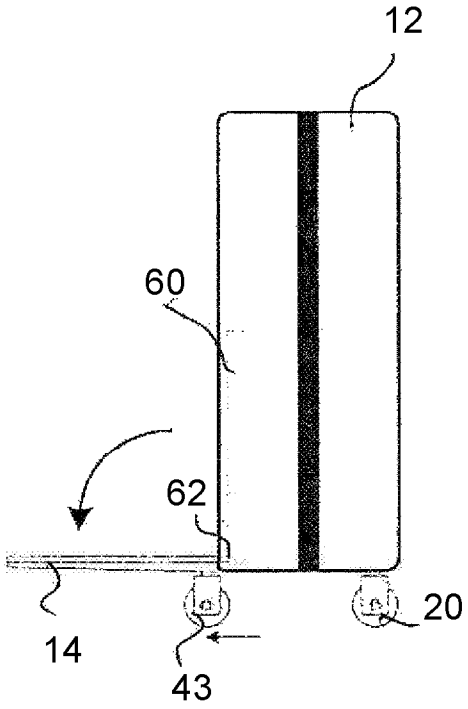
Figure 16C:
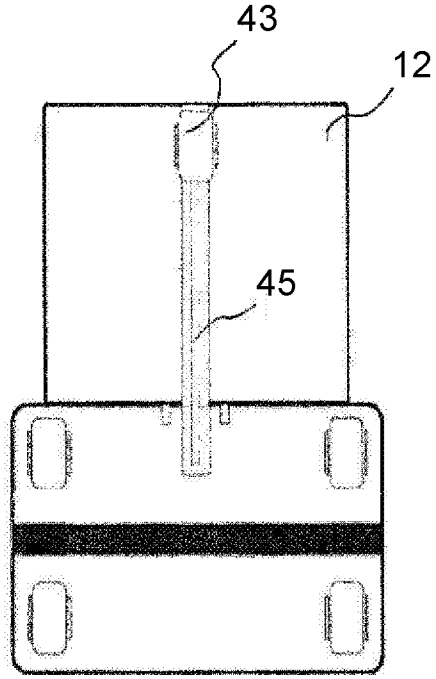
FIGS. 16A-16C are bottom views of the luggage transport system of FIG. 14A, showing the transport platform in various configurations.
Figure 16B:
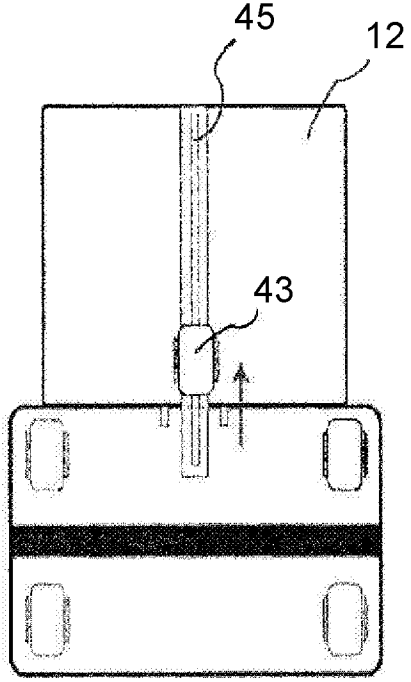
Figure 16A:
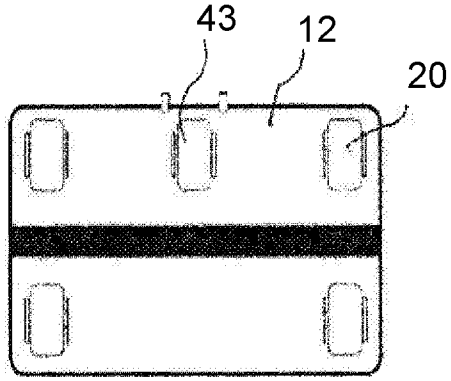
Figure 17:
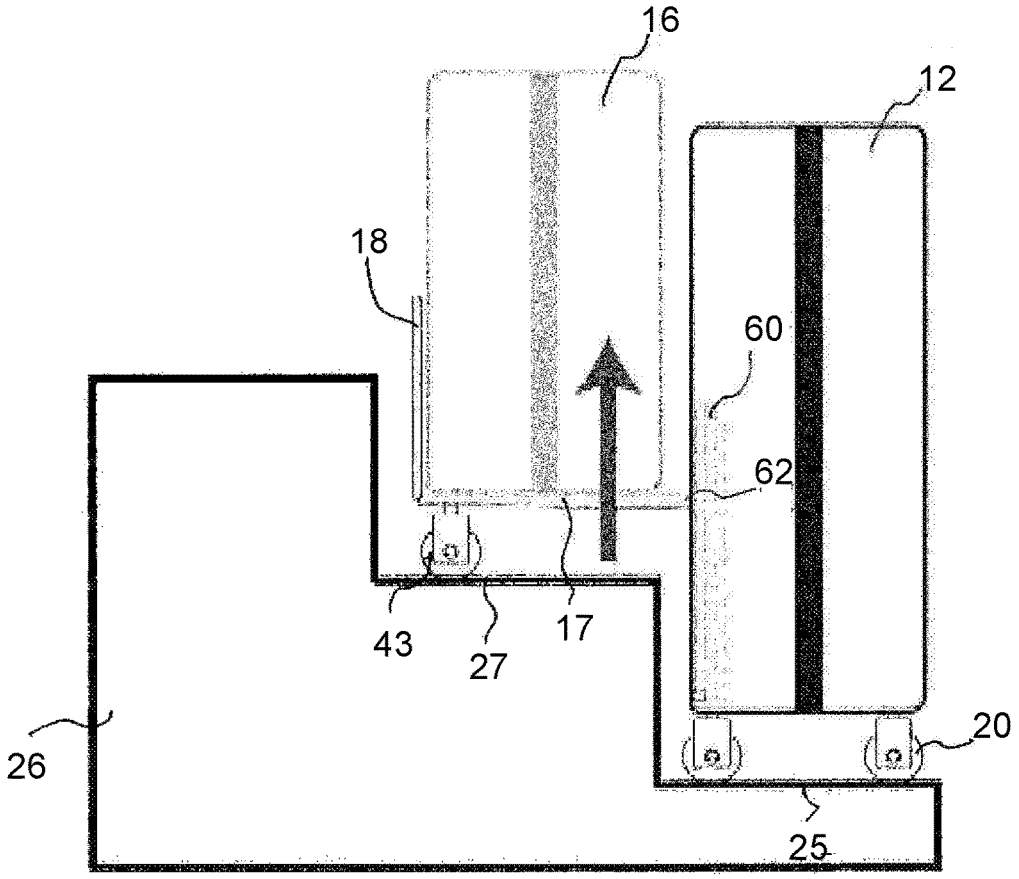
FIG. 17 is a side view of the luggage transport system of FIG. 14A, being transported on an escalator.

The protrusions 64 are pivotally attached to the platform 14 such that the platform 14 can be folded down away from the wall of the luggage piece 12, as shown in FIG. 15A, while being coupled to the luggage piece 12 via the channels 60. Any suitable pivotable attachment mechanism may be used. The bottom of the luggage piece 12 may have a movable wheel 43, which is slid underneath the platform 14 via the channel 45, as illustrated in FIGS. 15B and 16A-16C. The second portion 18 of the platform 14 may then be folded away from the first platform portion 17, as shown in FIG. 15C, to accommodate an additional piece of luggage.

When the luggage system is placed on the escalator 26, the transport platform 14 with the additional piece of luggage 16 supported thereon is elevated or lowered relating the first luggage piece 12. As the transport platform 14 moves relative the luggage piece 12, the protrusions 62 of the platform 14 slide inside the channels 60 of the luggage piece 12, allowing the platform and the luggage piece to move relative each other along the vertical axis of the luggage piece while remaining in a coupled configuration.

Figure 18A:
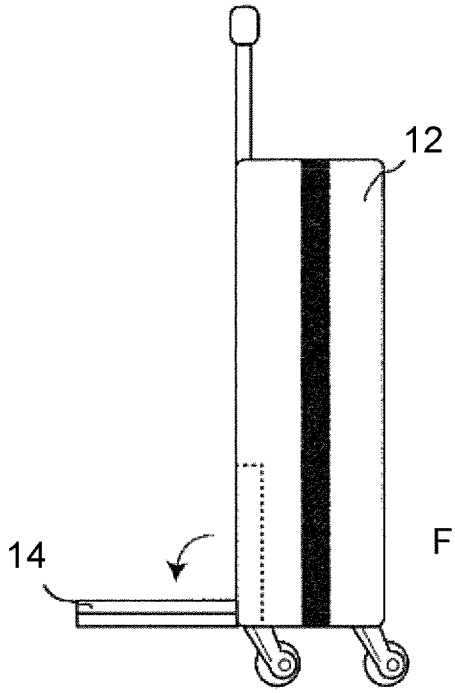
FIGS. 18A and 18B are side views of the luggage transport system of the present invention, with the transport platform attached to a rear wall of the luggage piece, showing the transport platform in different configurations.
Figure 18B:
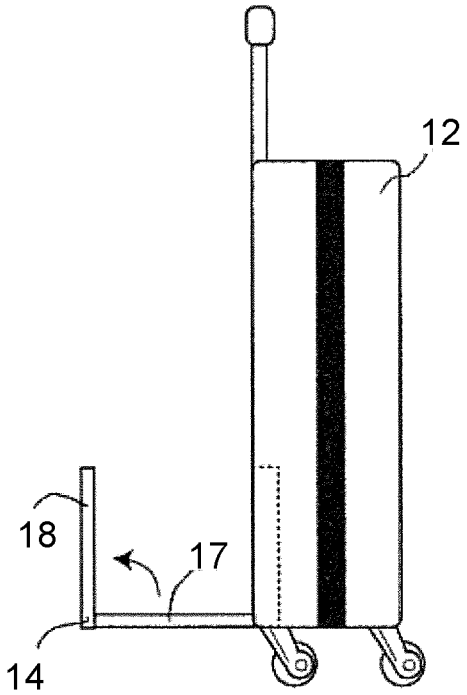
Figure 19A:
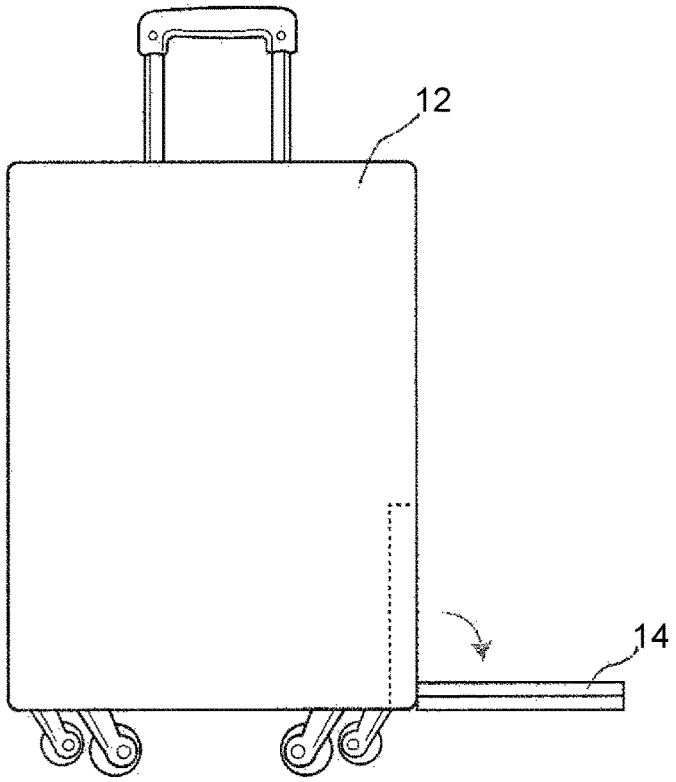
FIGS. 19A and 19B are front views of the luggage transport system of the present invention, with the transport platform attached to a side wall of the luggage piece, showing the transport platform in different configurations.
Figure 19B:
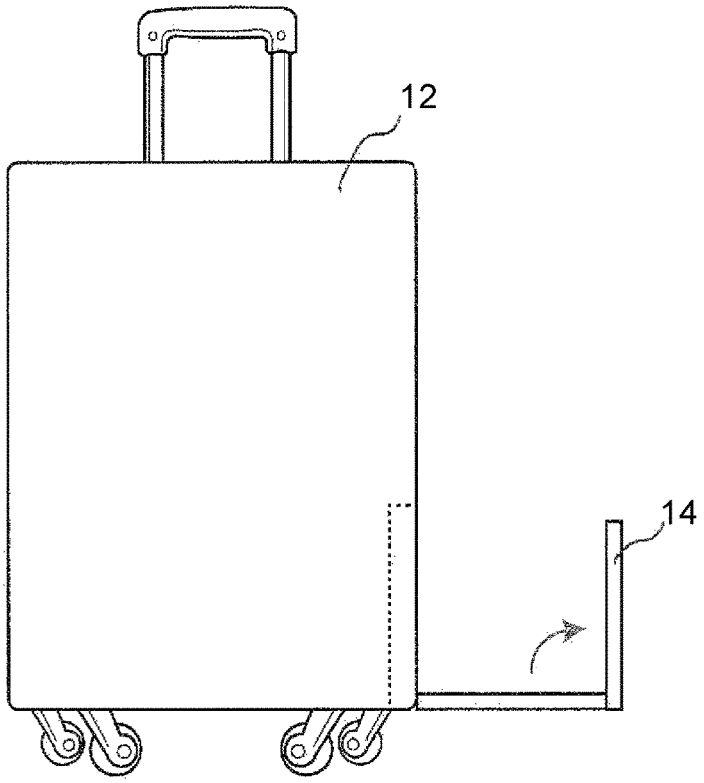

It is important to note that the attachment configurations between the luggage piece 12 and the transport platform 14 described above are only exemplary and that other attachment configurations may also be used. For example, as shown in FIGS. 18A and 18B, the transport platform 14 may be coupled to the rear wall of the luggage piece 12 instead of the front wall. In additional embodiments, the transport platform 14 may be coupled to one of the side walls of the luggage piece 12, as shown in FIGS. 19A and 19B.

Although the fold-out configuration of the transport platform is illustrated in FIGS. 18A-18B and 19A-19B, other configurations described above, e.g. slide-out configuration, may instead be utilized in these embodiments.

Figure 20B:
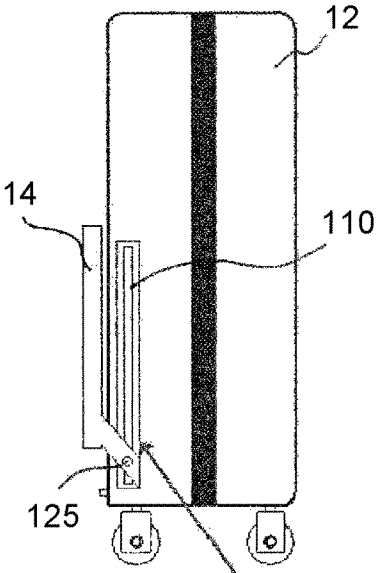
FIG. 20B is a side view of the luggage transport system of FIG. 20A.
Figure 20C:
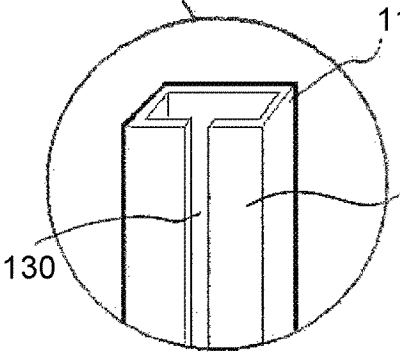
FIG. 20C is an enlarged front perspective view of an attachment member of the luggage transport system of FIG. 20A.
Figure 20A:
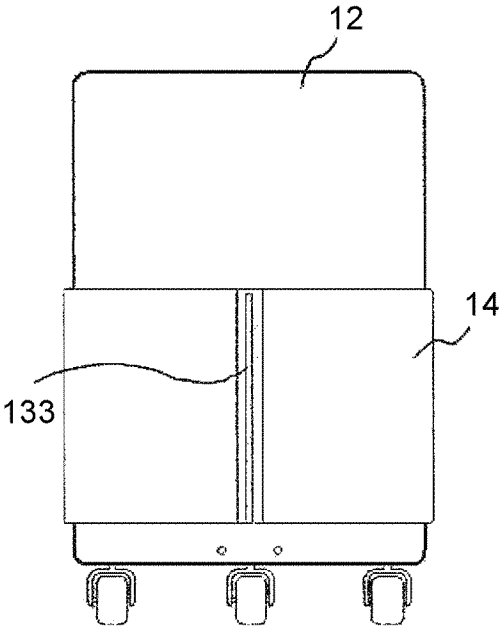
FIG. 20A is a front view of an additional embodiment of the luggage transport system in accordance with the present invention.

It is noted that the attachment mechanism can be positioned on side walls of the first piece of luggage, as opposed to the front wall or the rear wall. One example of such design is illustrated in FIGS. 20A-20C. In this embodiment, the first piece of luggage 12 has two attachment members 110 in a form of vertically extending channels positioned on opposing side walls of the luggage piece 12. The structure of the channels 110 is similar to the structure of the channels illustrated in FIGS. 14A-14C and discussed above. Each of the channels has an elongated opening 130, as seen in FIG.

20C, positioned on the sides 120 of the channels 110 that face away from the luggage side walls.

The transport platform 14 has two female attachment members 125 positioned at each side of the transport platform 14 facing the side walls of the luggage piece 12. As seen in FIG. 20A, in this embodiment, the transport platform 14 is slightly wider than the first piece of luggage 12 such that the sides of the transport platform extend beyond the side walls of the luggage piece 12. The female attachment members 125 are in a form of two arms that each have a protrusion that is movably engages inside one of the channels 110 through the opening 130 to couple the transport platform 14 to the luggage piece 12.

Figure 21B:
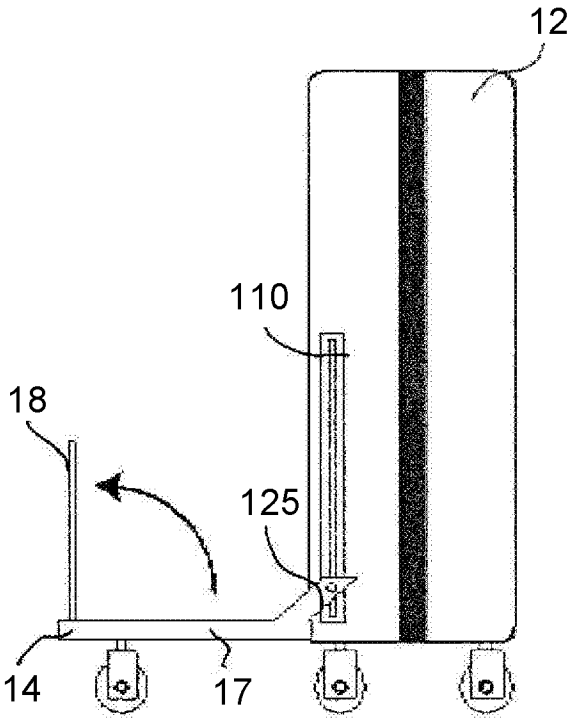
FIGS. 21A and 21B are side views of the luggage transport system of FIG. 20A, showing the transport platform in different configurations.
Figure 21A:
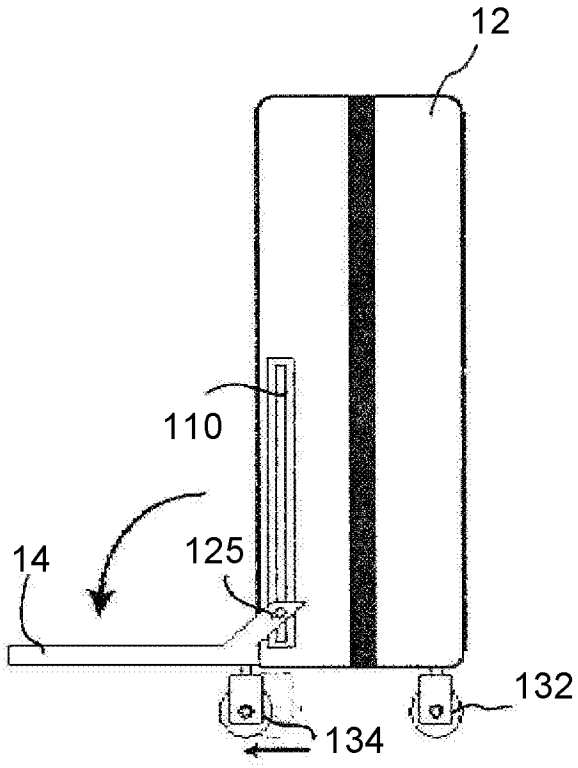

When in non-working configuration shown in FIG. 20A, the transport platform 14 is folded up towards the wall of the luggage piece 12. In order to use the platform 14, it is pivoted down until the platform 14 is substantially parallel to the bottom of the luggage piece 12, as illustrated in FIG. 21A. The female attachment members 125 allow the platform to pivot downwards, by for example, providing protrusions that are pivotally attached to the arms such that the arms can rotate down which the protrusions are engages in the channels 110. An additional support wheel 134 may be moved underneath the transport platform 14 through the channel 133 provided on the bottom wall of the platform 14, similarly to the embodiments illustrated in FIGS. 8A-8C. If the platform 14 has two parts, the second part 18 is then moved to its upright position substantially perpendicular to the first part 17 of the platform, as shown in FIG. 21B, such that one or more additional pieces of luggage can be accommodated on the platform.

Figure 22:
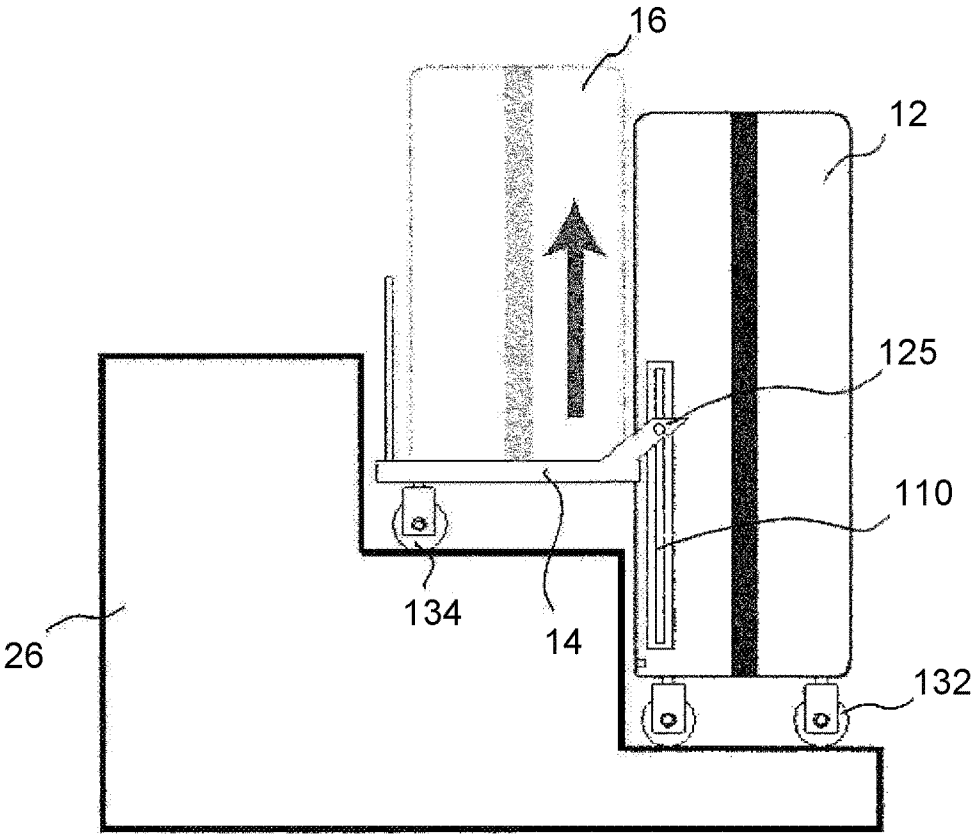
FIG. 22 is a side view of the luggage transport system of FIG. 20A, being transported on an escalator.

When the system is transported on an escalator, as shown in FIG. 22, the transport platform 14 with a second piece of luggage 16 rests on a first escalator step, while the first piece of luggage 12 rests on a second escalator step below the first step. As the steps move, the transport platform 14 is elevated relative the first luggage 12 as the female attachment members 125 slide inside the channels 110, while the platform remains coupled to the luggage piece.

Figure 23B:
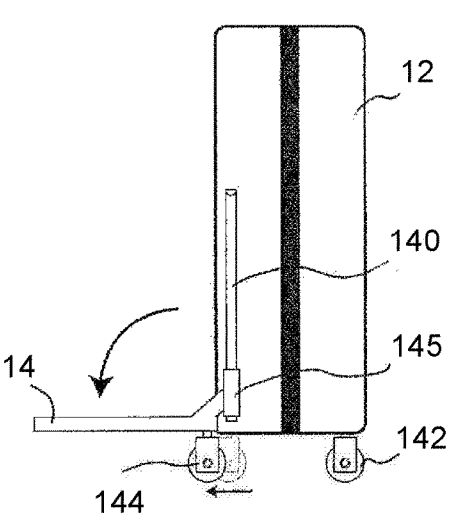
FIGS. 23A-23C are side view of a further embodiment of the luggage transport system of the present invention, showing the transport platform in different configurations.
Figure 23C:
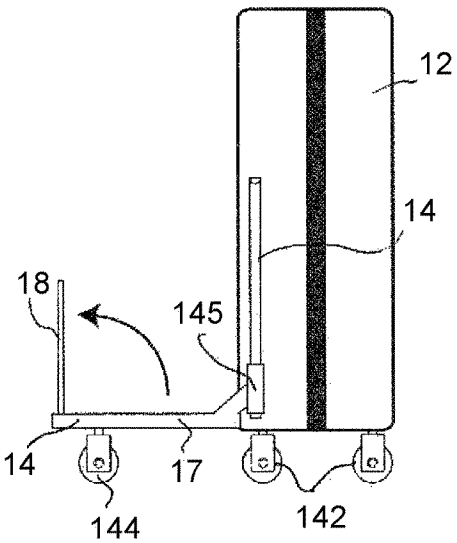
Figure 23A:
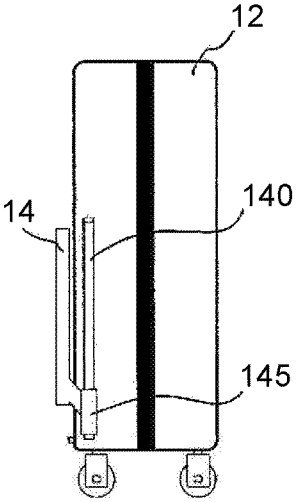

Other types of attachment mechanisms may also be used to couple the transport platform to the side walls of the luggage piece. For example, as shown in FIGS. 23A-23C, one vertically extending rod-like attachment member 140 is attached to each side wall of the first luggage piece 12. The transport platform 14 includes two female attachment members 145 positioned at each side of the platform. The female attachment members 145 are in a form of cylindrical members that fit over the rod-like attachment members 140 to movable couple the platform 14 to the luggage piece 12. When it is desired to use the transport platform 14, it is pivoted down from its non-working position shown in FIG. 23A to a working position shown in FIG. 23B. Similarly to the embodiment described above with respect to FIGS. 21A-21B, the transport platform may have an additional wheel 144 and may have a first portion 17 and a second portion 18 that is pivoted to a position perpendicular to the first portion 17.

Figure 24:
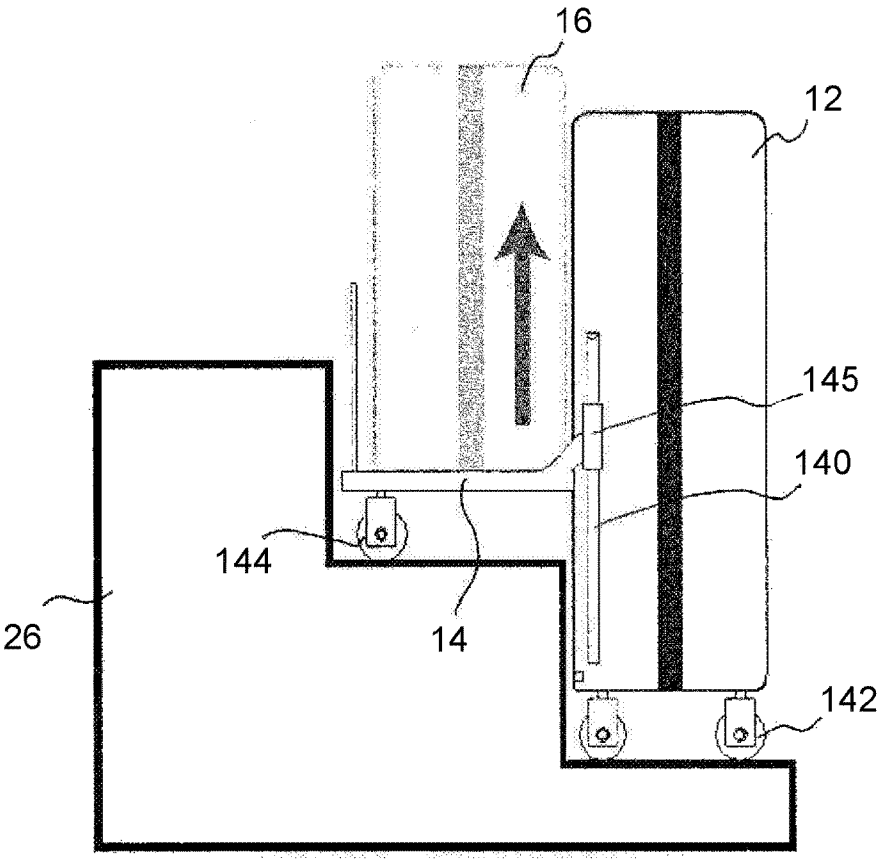
FIG. 24 is a side view of the luggage transport system of FIGS. 23A-23C being transported on an escalator.

When the luggage system is transported on an escalator 26, as illustrated in FIG. 24, the transport platform 14 with the second piece of luggage 16 is elevated and lowered relative the first luggage piece 12 by means of the cylindrical attachment members 145 sliding up and down the rod-like attachment members 140.

Figure 25B:
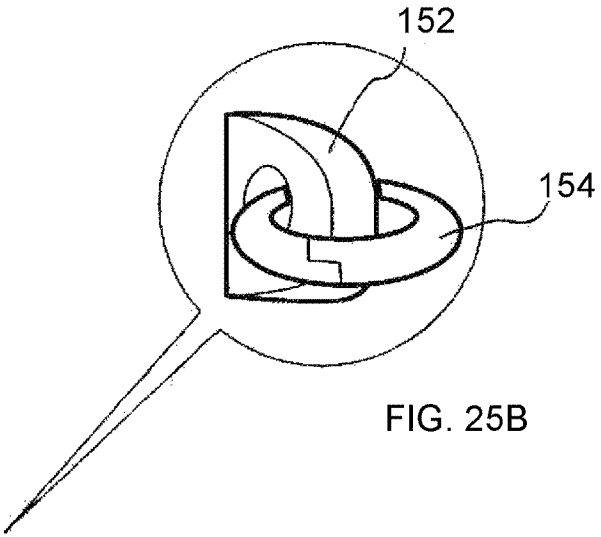
FIG. 25B is an enlarged perspective view of an attachment member of the luggage transport system of FIG. 25A.
Figure 25A:
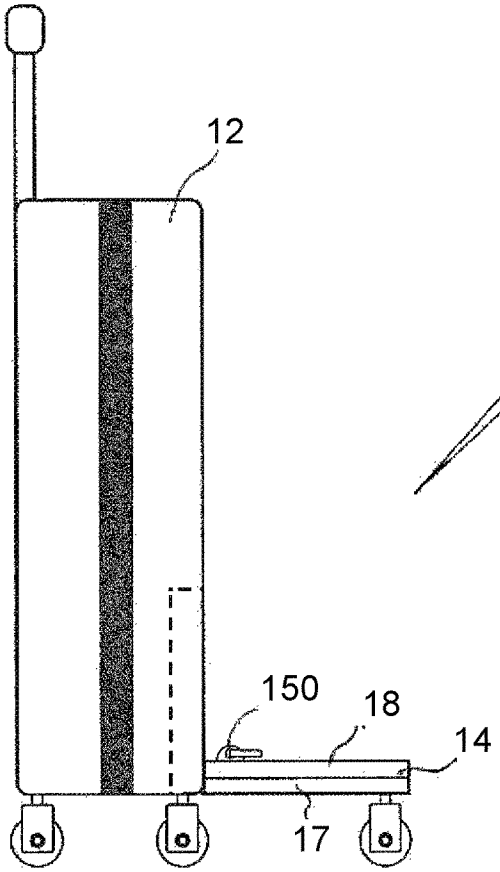
FIG. 25A is a side view of yet another embodiment of the luggage transport system of the present invention.
Figure 25C:
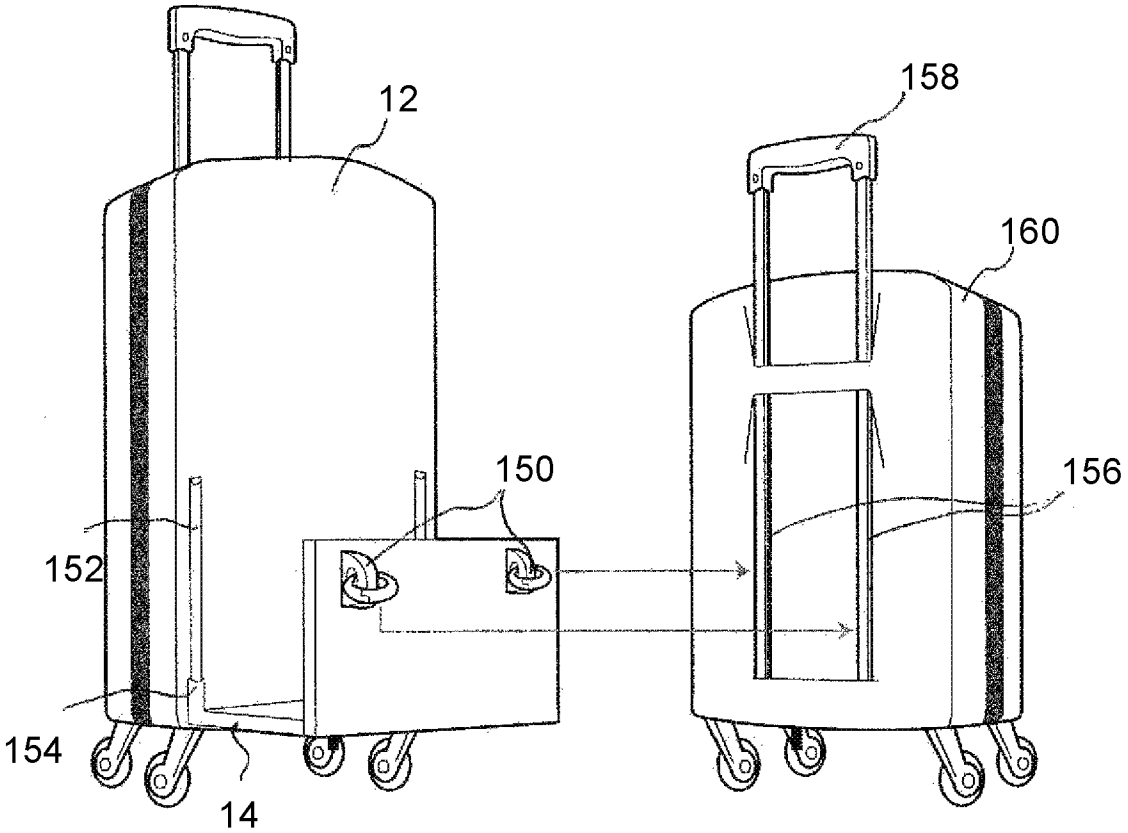
FIGS. 25C and 25D illustrate the luggage transport system of FIG. 25A, showing attachment to another piece of luggage.

Another example of the luggage transport system of the present invention is illustrated in FIGS. 25A-25E. In this exemplary embodiment, the transport platform 14 has a first portion 17 and a second portion 18 that unfolds until it is perpendicular to the first portion 17 when in a working configuration, as seen in FIG. 25C. The second portion 18 includes a third attachment member 150 coupled to the wall of the second portion 18 that faces away from the first piece of luggage 12. The attachment member 150 may be of any suitable type. In the example shown in FIGS. 25A-25C, the attachment member 150 has a base part 152 that is coupled to the platform 14 and a ring member 154 threaded through an opening in the base member 152.

The transport platform 14 is coupled to the first piece of luggage 12 via any suitable mechanism described above that allows the platform 14 and the luggage piece 12 to move up and down relative each other while remaining in the engaged configuration.

A third piece of luggage 160 may be attached to the transport platform 14, as shown in FIG. 25C. The third piece of luggage has a fourth attachment member 156 that engages the third attachment member 150 of the transport platform to movably couple the platform to the third luggage piece 160. In the exemplary embodiment illustrated in this figure, the fourth attachment member 150 is formed by two vertically extending rods formed by the handle frame 158 of the third piece of luggage 160. Such attachment is advantageous because it allows for use of an existing standalone luggage piece 160 as a part of the luggage transport system, without the need to purchase a specifically designed luggage piece. It is understood, however, that any other attachment mechanisms described above may also be used.

Figure 25E:
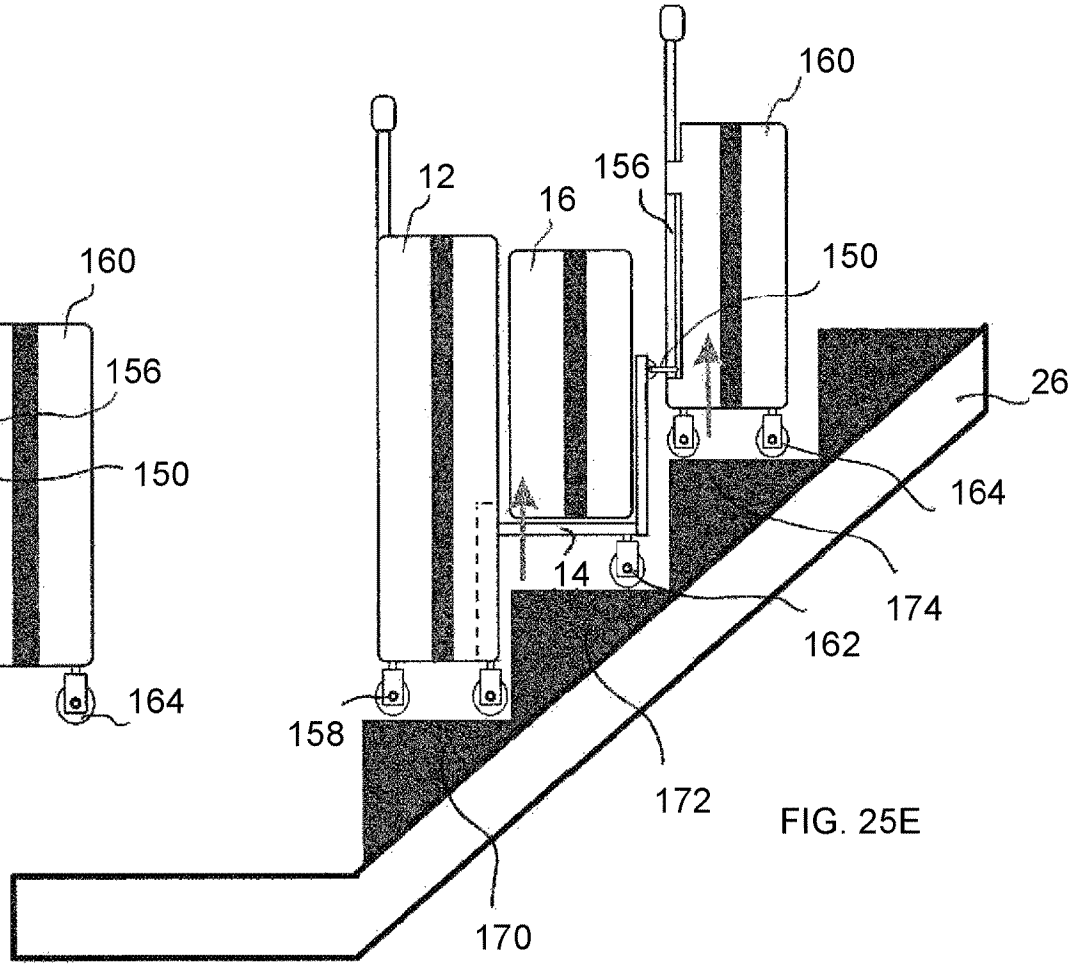
FIG. 25E is a side view of the luggage transport system of FIG. 25A being transported on an escalator.
Figure 25D:
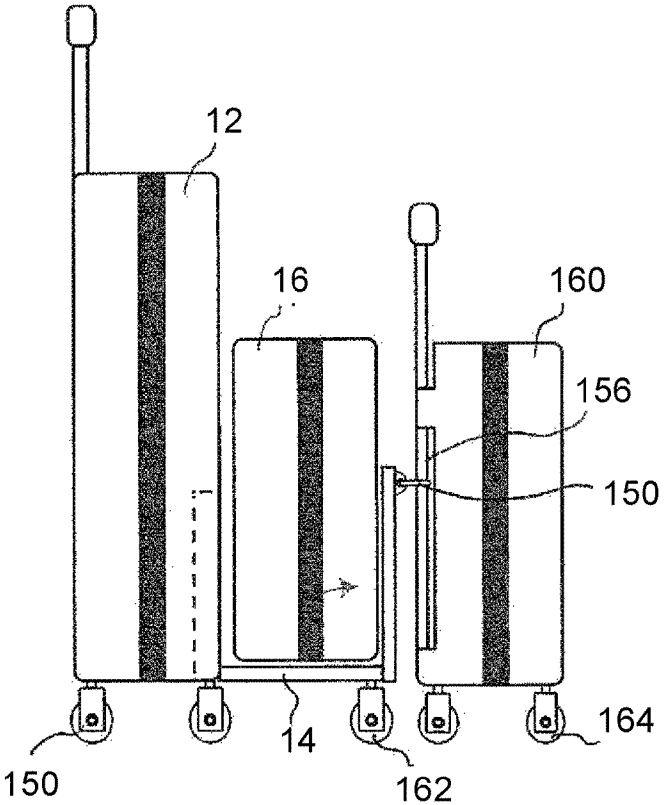

Once the transport platform 14 is brought into its working configuration, the ring-like attachment members 150 of the platform 14 are engaged with the rod-like attachment members 156 of the third luggage piece 160, as seen in FIG. 25D. This can be done by using the rings that are capable of clipping the rings 150 to the rods 156, such as, e.g. carabiner-type attachment.

When the entire luggage system is placed on an escalator 26, as shown in FIG. 25E, the wheels 158 of the first piece of luggage 12 are placed on a first escalator step 170, the wheels of the transport platform 162 that supports the second piece of luggage 16 are placed on a second escalator step 172, and the wheels of the third piece of luggage 160 are placed on a third escalator step 174. As the escalator begins to ascend, the transport platform 14 with the second piece of luggage is elevated relative the first luggage piece by slidably engaging the attachment first and second attachment members. The third piece of luggage 160 is elevated relative the transport platform 14 by slidably engaging the third and fourth attachment members 150 and 156. This way, the weigh of each piece of luggage is distributed over a separate escalator step, such that the entire system can be easily transported on the escalator. Once the system reaches the top of the escalator, the first luggage piece 12, the transport platform 14 and the third luggage piece 160 are leveled again such that they can be easily wheeled off the escalator and transported on the ground.

It is understood that while the ring-rod attachment mechanism between the transport platform and the third piece of luggage is described, any other suitable attachment mechanism may be used, for example, a channel-protrusion type mechanism.

Although the fold-out configuration of the transport platform is illustrated in FIGS. 20A-25E, other configurations described above, e.g. slide-out configuration, may instead be utilized in these embodiments.

Figure 26C:
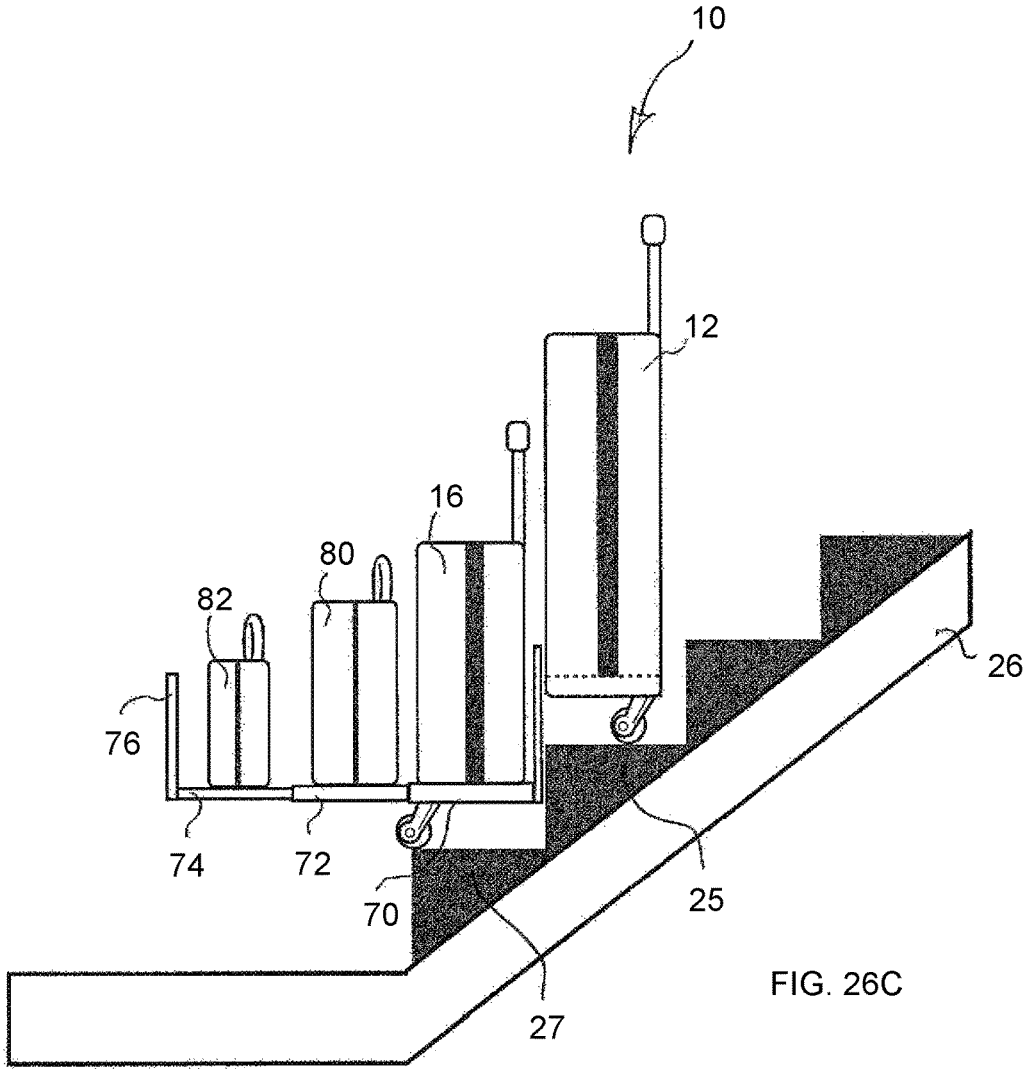

FIGS. 26A-26C depict yet another configuration of the transport platform 14. In this configuration, the transport platform 14 includes two or more telescoping portions. In the non-working configuration, the platform 14 is slid under the luggage piece 12. Then, as shown in FIG. 26A, a first portion 70 of the platform 14 is pulled out, while other telescoping portions of the platform are positioned inside the first portion 70. Preferably, the first portion 70 has a wheel 43 positioned underneath it to support the weight of the telescoping platform portions and additional pieces of luggage placed thereon. The second and third portions 72, 74 of the transport platform 14 can then be pulled out as needed, as shown in FIG. 26B, to accommodate additional pieces of luggage.

One or both of the second and third telescoping portions 72, 74 may have an additional wheel 78, as seen in FIG. 26B, to further assist in distributing the weight of the entire luggage system. In some embodiments, the wheel 78 may fold into one of the platform portions 72 or 74 when the portions are in the non-working configuration or when the additional wheel is not needed. The telescoping transport platform 14 can also have a terminal fold-out portion 76, as described above, that functions to prevent luggage pieces from sliding off the platform.

As shown in FIG. 26C, once the luggage transport system 10 is placed on the escalator 26, the luggage piece 12 rests of the first escalator step 25, and the first portion 70 of the telescoping platform 14 rests on the second escalator step 27. The first portion 70 accommodates the additional piece of luggage 16. The second and third telescoping portions 72 and 74 extend from the first portion 70 and accommodate additional pieces of luggage 80 and 82 respectively. Because the length of the extended telescoping portions of the platform 14 exceeds the length of the escalator step 27, the second and third portions 72, 74 extend over the escalator without resting on the escalator steps. As the steps 25 and 27 move relative each other, the entire telescoping platform 14 with the additional luggage pieces 16, 80, 82 moves relative the luggage piece 12. The movement of the platform 14 is accomplished via any suitable attachment mechanism described above.

Although FIGS. 26A-26C illustrate the slide-out embodiment of the telescoping transport platform, it is understood that other platform embodiments described above maybe used, e.g. fold-out embodiment. It is also understood that the platform may have as many telescoping portions as desired, and that the portions may differ in size and shape, to accommodate different pieces of luggage.

It should be understood that the foregoing is illustrative and not limiting, and that obvious modifications may be made by those skilled in the art without departing from the spirit of the invention. Accordingly, reference should be made primarily to the accompanying claims, rather than the foregoing specification, to determine the scope of the invention.

What is claimed is:

1. A luggage transport system, comprising:

a first piece of luggage, a transport platform movably coupled to the first piece of luggage, and at least one additional piece of luggage supported on the transport platform, wherein the first piece of luggage comprises a first attachment member and the transport platform comprises a second attachment member that movably engages the first attachment member, wherein the transport platform is adapted to be elevated and lowered relative the first piece of luggage, and wherein the first piece of luggage comprises two or more wheels and is supported on a surface independent of the transport platform.

2. The luggage transport system of claim 1, wherein the transport platform further comprises at least one pivoting member and folds upward towards a wall of the first piece of luggage when not in use and folds downward when in use.

3. The luggage transport system of claim 2, wherein the transport platform folds to a front wall of the first piece of luggage.

4. The luggage transport system of claim 2, wherein the transport platform folds to a rear wall of the first piece of luggage.

5. The luggage transport system of claim 2, wherein the transport platform folds to one of sidewalls of the first piece of luggage.

6. The luggage transport system of claim 1, wherein the transport platform comprises a first part and a second part, wherein the second part is movable from a first position in which the second part is substantially parallel to the first part, to a second position, in which the second part is substantially perpendicular to the first part.

7. The luggage transport system of claim 1, wherein the transport platform includes at least one wheel movably positioned on its bottom surface.

8. The luggage transport system of claim 7, wherein the transport platform further includes a channel positioned on its bottom surface that movably engages the wheel such that the wheel is positioned under the first piece of luggage when the transport platform is not in use and is slid out and positioned under the transport platform when the platform is in use.

9. The luggage transport system of claim 1, wherein the first attachment member comprises at least one channel and the second attachment member comprises at least one protrusion that slidably engages the at least one channel such that the first piece of luggage and the transport platform slide up and down relative each other.

10. The luggage transport system of claim 1, wherein the first attachment member comprises one or more toothed channels and the second attachment member comprises one or more toothed wheels that movably engage the toothed channels such that the first piece of luggage and the transport platform move up and down relative each other.

11. The luggage transport system of claim 1, wherein the first piece of luggage comprises a handle for transporting the luggage system.

12. A luggage transport system, comprising:

a first piece of luggage having a vertical axis, and a transport platform movably coupled to the first piece of luggage and adapted for supporting at least one additional piece of luggage when in a working position, wherein the first piece of luggage comprises a first attachment member and the transport platform comprises a second attachment member that movably engages the first attachment member, wherein the transport platform is movable along the vertical axis of the first piece of luggage when in the working position, and wherein the first piece of luggage comprises two or more wheels and is supported on a surface independent of the transport platform.

13. The luggage transport system of claim 12, wherein the first attachment member comprises one or more channels extending substantially parallel to the vertical axis of the first piece of luggage and having an opening on one side that is opposite a side that faces a wall of the first piece of luggage, wherein the channel opening has an inner diameter.

14. The luggage transport system of claim 12, wherein the second attachment member comprises at least one protrusion positioned on the transport platform and slidably engaging the at least one channel such that the first piece of luggage and the transport platform slide up and down with respect to each other, wherein the protrusion has an outer diameter that is larger than the inner diameter of the channel opening.

15. The luggage transport system of claim 12, wherein the first attachment member comprises one or more channels extending substantially parallel to the vertical axis of the first piece of luggage and having two opposing sides, wherein at least one of the opposing sides has a plurality of teeth.

16. The luggage transport system of claim 15, wherein the first attachment member comprises a first channel positioned on one side wall of the first piece of luggage and a second channel positioned on the opposite side of the first piece of luggage.

17. The luggage transport system of claim 15, wherein the second attachment member comprises one or more rotating wheels coupled to the transport platform and having a plurality of teeth corresponding to the plurality of teeth of the one or more channels, wherein the plurality of teeth of the one or more rotating wheels movably engage the plurality of teeth of the one or more channels such that the first piece of luggage and the transport platform move up and down with respect to each other.

18. The luggage transport system of claim 12, wherein the transport platform is removably attached to the first piece of luggage.

19. The luggage transport system of claim 12, wherein the first piece of luggage has a bottom portion and comprises a first sliding member and wherein the transport platform comprises a second member that engages the first sliding member such that the transport platform slides under the bottom portion of the first piece of luggage when not in use.

* * * * *